US010753676B2

(12) United States Patent
Krishnamurthy et al.

(10) Patent No.: US 10,753,676 B2
(45) Date of Patent: Aug. 25, 2020

(54) MULTIPLE PRESSURE MIXED REFRIGERANT COOLING PROCESS

(71) Applicant: Air Products and Chemicals, Inc., Allentown, PA (US)

(72) Inventors: Gowri Krishnamurthy, Sellersville, PA (US); Mark Julian Roberts, Kempton, PA (US); Adam Adrian Brostow, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 15/718,068

(22) Filed: Sep. 28, 2017

(65) Prior Publication Data

US 2019/0093946 A1 Mar. 28, 2019

(51) Int. Cl.
*F25J 1/00* (2006.01)
*F25J 1/02* (2006.01)

(52) U.S. Cl.
CPC ..... *F25J 1/0022* (2013.01); *F25J 1/006* (2013.01); *F25J 1/0052* (2013.01); *F25J 1/0055* (2013.01); *F25J 1/0211* (2013.01); *F25J 1/0219* (2013.01); *F25J 1/0257* (2013.01); *F25J 1/0267* (2013.01); *F25J 1/0291* (2013.01); *F25J 1/0292* (2013.01); *F25J 1/0294* (2013.01); *F25J 2220/62* (2013.01)

(58) Field of Classification Search
CPC ..... F25J 1/0022; F25J 1/0211; F25J 1/0212; F25J 1/0092; F25J 1/0219; F25J 1/0214; F25J 1/0215; F25J 1/0216; F25J 1/0217; F25J 1/0218; F25J 2270/66
USPC ..... 62/612
See application file for complete search history.

(56) References Cited

U.S. PATENT DOCUMENTS 4,229,195 A 10/1980 Foerg
4,525,185 A 6/1985 Newton
4,541,852 A 9/1985 Newton et al.
(Continued)

FOREIGN PATENT DOCUMENTS

EP 1092932 4/2001
FR 2967484 5/2012
(Continued)

OTHER PUBLICATIONS

Pierre Rabeau, et al, "How to Reduce CO2 Emissions in the LNG Chain", International Conference and Exhibition on Liquefied Natural Gas, Apr. 24, 2007, 1-19.
(Continued)

*Primary Examiner* — Henry T Crenshaw
*Assistant Examiner* — Kamran Tavakoldavani
(74) *Attorney, Agent, or Firm* — Amy Carr-Trexler

(57) ABSTRACT

Systems and methods described for increasing capacity and efficiency of natural gas liquefaction processes having a mixed refrigerant precooling system with multiple pressure levels comprising cooling the compressed mixed refrigerant stream and separating the cooled compressed mixed refrigerant stream into a vapor and liquid portion. The liquid portion provides refrigeration duty to a first precooling heat exchanger. The vapor portion is further compressed, cooled, and condensed, and used to provide refrigeration duty to a second precooling heat exchanger. A flash gas separated from the liquefied natural gas is warmed and combined with the natural gas feed stream.

20 Claims, 6 Drawing Sheets

(56) References Cited

U.S. PATENT DOCUMENTS

| | | | | |
|---|---|---|---|---|
| 4,545,795 | A | 10/1985 | Liu et al. | |
| 4,755,200 | A | 7/1988 | Liu et al. | |
| 6,105,389 | A | 8/2000 | Paradowski et al. | |
| 6,119,479 | A | 9/2000 | Roberts et al. | |
| 6,253,574 | B1 * | 7/2001 | Stockmann ..... | F25J 1/002 62/612 |
| 6,269,655 | B1 | 8/2001 | Roberts et al. | |
| 6,347,531 | B1 | 2/2002 | Roberts et al. | |
| 6,347,532 | B1 | 2/2002 | Agrawal et al. | |
| 6,427,483 | B1 | 8/2002 | Rashad et al. | |
| 8,534,094 | B2 | 9/2013 | Teo | |
| 2006/0162378 | A1 | 7/2006 | Roberts | |
| 2010/0223951 | A1 | 9/2010 | Jager et al. | |
| 2010/0293997 | A1 | 11/2010 | Chantant et al. | |
| 2016/0061516 | A1 | 3/2016 | Seitter et al. | |

FOREIGN PATENT DOCUMENTS

| | | |
|---|---|---|
| RU | 2253809 | 6/2005 |
| RU | 2538156 | 1/2015 |
| WO | 20090124925 | 10/2009 |
| WO | 2009153427 | 12/2009 |

OTHER PUBLICATIONS

R. A. Denton, et al, "ExxonMobil Enhanced Mixed Refrigerant (EMR) Process for Next Generation LNG Projects", 90th Annual Convention of the Gas Processors Association 2011.

P-Y. Martin, et al, Liquefin: An Innovative Process to Reduce LNG Costs.

J. Seitter, et al, "PRICO-DMR: An Innovative Approach to Highly Efficient, Scalable, and Cost-Competitive LNG", LNG 18, Perth, Australia, Apr. 11-15, 2016.

"PRICO-DMR Technology", Efficiency with Dual Mixed Refrigerant, Black & Veatch.

H. Paradowski, et al, "Liquefaction of Associated Gases", LNG 7, Jakarta, May 15-18, 1983.

G. Krishnamurthy, et al, "The Road to Recovery", LNG Industry, Jan. 2015.

* cited by examiner

MULTIPLE PRESSURE MIXED REFRIGERANT COOLING PROCESS

BACKGROUND

A number of liquefaction systems for cooling, liquefying, and optionally sub-cooling natural gas are well known in the art, such as the single mixed refrigerant (SMR) cycle, the propane-precooled mixed refrigerant (C3MR) cycle, the dual mixed refrigerant (DMR) cycle, C3MR-Nitrogen hybrid (such as AP-X™) cycles, the nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and a refrigerant compression system. The refrigerant circuit may be closed-loop or open-loop. Natural gas is cooled, liquefied, and/or sub-cooled by indirect heat exchange in one or more refrigerant circuits by indirect heat exchange with the refrigerants in the heat exchangers.

The refrigerant compression system includes a compression sequence for compressing and cooling the circulating refrigerant, and a driver assembly to provide the power needed to drive the compressors. For precooled liquefaction systems, the quantity and type of drivers in the driver assembly and the compression sequence have an impact on the ratio of the power required for the precooling system and the liquefaction system. The refrigerant compression system is a critical component of the liquefaction system because the refrigerant needs to be compressed to high pressure and cooled prior to expansion in order to produce a cold, low pressure refrigerant stream that provides the heat duty necessary to cool, liquefy, and optionally sub-cool the natural gas.

DMR processes involve two mixed refrigerant streams, the first for precooling the feed natural gas and the second for liquefying the precooled natural gas. The two mixed refrigerant streams pass through two refrigerant circuits, a precooling refrigerant circuit within a precooling system, and a liquefaction refrigerant circuit within a liquefaction system. In each refrigerant circuit, the refrigerant stream is vaporized while providing the cooling duty required to cool and liquefy the natural gas feed stream. When a refrigerant stream is vaporized at a single pressure level, the system and process is referred to as "single pressure". When a refrigerant stream is vaporized at two or more pressure levels, the system and process is referred to as "multiple pressure". Referring to FIG. 1, a DMR process of the prior art is shown in cooling and liquefaction system 100. The DMR process described herein involves a single pressure liquefaction system and a multiple pressure precooling system with two pressure levels. However, any number of pressure levels may be present. A feed stream, which is preferably natural gas, is cleaned and dried by known methods in a pretreatment section (not shown) to remove water, acid gases such as $CO_2$ and $H_2S$, and other contaminants such as mercury, resulting in a pretreated feed stream 102. The pretreated feed stream 102, which is essentially water free, is precooled in a precooling system 134 to produce a second precooled natural gas stream 106 and further cooled, liquefied, and/or sub-cooled in a main cryogenic heat exchanger (MCHE) 164 to produce a first LNG stream 108. The first LNG stream 108 is typically let down in pressure by passing it through an LNG pressure letdown device 111 to produce a reduced pressure LNG stream 103, which is then sent to a flash drum 107 to produce a flash gas stream 109 and a second LNG stream 105. The second LNG stream 105 may be let down to storage pressure and sent to an LNG storage tank (not shown). The flash gas stream 109 and any boil-off gas (BOG) produced in the storage tank may be used as fuel in the plant and/or sent to flare.

The pretreated feed stream 102 is cooled in a first precooling heat exchanger 160 to produce a first precooled natural gas stream 104. The first precooled natural gas stream 104 is cooled in a second precooling heat exchanger 162 to produce the second precooled natural gas stream 106. The second precooled natural gas stream 106 is liquefied and subsequently sub-cooled to produce the first LNG stream 108 at a temperature between about −170 degrees Celsius and about −120 degrees Celsius, preferably between about −170 degrees Celsius and about −140 degrees Celsius. MCHE 164 shown in FIG. 1 is a coil wound heat exchanger with two tube bundles, a warm bundle 166 and a cold bundle 167. However, any number of bundles and any exchanger type may be utilized. Although FIG. 1 shows two precooling heat exchangers and two pressure levels in the precooling circuit, any number of precooling heat exchangers and pressure levels may be utilized. The precooling heat exchangers are shown to be coil wound heat exchangers in FIG. 1. However, they may be plate and fin heat exchangers, shell and tube heat exchangers, or any other heat exchangers suitable for precooling natural gas.

The term "essentially water free" means that any residual water in the pretreated feed stream 102 is present at a sufficiently low concentration to prevent operational issues associated with water freeze-out in the downstream cooling and liquefaction process. In the embodiments described herein, water concentration is preferably not more than 1.0 ppm and, more preferably between 0.1 ppm and 0.5 ppm.

The precooling refrigerant used in the DMR process is a mixed refrigerant (MR) referred to herein as warm mixed refrigerant (WMR) or "first refrigerant", comprising components such as nitrogen, methane, ethane/ethylene, propane, butanes, and other hydrocarbon components. As illustrated in FIG. 1, a low pressure WMR stream 110 is withdrawn from the warm end of the shell side of the second precooling heat exchanger 162 and compressed in a first compression stage 112A of a WMR compressor 112. A medium pressure WMR stream 118 is withdrawn from the warm end of the shell side of the first precooling heat exchanger 160 and introduced as a side-stream into the WMR compressor 112, where it mixes with the compressed stream (not shown) from the first compression stage 112A. The mixed stream (not shown) is compressed in a second WMR compression stage 112B of the WMR compressor 112 to produce a compressed WMR stream 114. Any liquid present in the low pressure WMR stream 110 and the medium pressure WMR stream 118 is removed in vapor-liquid separation devices (not shown).

The compressed WMR stream 114 is cooled and preferably condensed in WMR aftercooler 115 to produce a first cooled compressed WMR stream 116, which is introduced into the first precooling heat exchanger 160 to be further cooled in a tube circuit to produce a second cooled compressed WMR stream 120. The second cooled compressed WMR stream 120 is split into two portions: a first portion 122 and a second portion 124. The first portion of the second cooled compressed WMR stream 122 is expanded in a first WMR expansion device 126 to produce a first expanded WMR stream 128, which is introduced into the shell side of the first precooling heat exchanger 160 to provide refrigeration duty. The second portion of the second cooled compressed WMR stream 124 is introduced into the second precooling heat exchanger 162 to be further cooled, after which it is expanded in a second WMR expansion device 130 to produce a second expanded WMR stream 132, which is introduced into the shell side of the second precooling heat exchanger 162 to provide refrigeration duty. The process of compressing and cooling the WMR after it is withdrawn from the precooling heat exchangers is generally referred to herein as the WMR compression sequence.

Although FIG. 1 shows that compression stages 112A and 112B are performed within a single compressor body, they may be performed in two or more separate compressors. Further, intermediate cooling heat exchangers may be provided between the stages. The WMR compressor 112 may be any type of compressor such as centrifugal, axial, positive displacement, or any other compressor type.

In the DMR process, liquefaction and sub-cooling is performed by heat exchanging precooled natural gas against a second mixed refrigerant stream, referred to herein as cold mixed refrigerant (CMR) or "second refrigerant".

A warm low pressure CMR stream 140 is withdrawn from the warm end of the shell side of the MCHE 164, sent through a suction drum (not shown) to separate out any liquids and the vapor stream is compressed in CMR compressor 141 to produce a compressed CMR stream 142. The warm low pressure CMR stream 140 is typically withdrawn at a temperature at or near WMR precooling temperature and preferably less than about −30 degree Celsius and at a pressure of less than 10 bara (145 psia). The compressed CMR stream 142 is cooled in a CMR aftercooler 143 to produce a compressed cooled CMR stream 144. Additional phase separators, compressors, and aftercoolers may be present. The process of compressing and cooling the CMR after it is withdrawn from the warm end of the MCHE 164 is generally referred to herein as the CMR compression sequence.

The compressed cooled CMR stream 144 is then cooled against evaporating WMR in precooling system 134. The compressed cooled CMR stream 144 is cooled in the first precooling heat exchanger 160 to produce a first precooled CMR stream 146 and then cooled in the second precooling heat exchanger 162 to produce a second precooled CMR stream 148, which may be fully condensed or two-phase depending on the precooling temperature and composition of the CMR stream. The CMR stream 148 is then liquefied and/or subcooled in the liquefaction system 165. FIG. 1 shows an arrangement wherein the second precooled CMR stream 148 is two-phase and is sent to a CMR phase separator 150 to produce a CMR liquid (CMRL) stream 152 and a CMR vapor (CMRV) stream 151, which are both sent back to the MCHE 164 to be further cooled. Liquid streams leaving phase separators are referred to in the industry as MRL and vapor streams leaving phase separators are referred to in the industry as MRV, even after they are subsequently liquefied.

Both the CMRL stream 152 and CMRV stream 151 are cooled in two separate circuits of the MCHE 164. The CMRL stream 152 is cooled in a warm bundle 166 of the MCHE 164, resulting in a cold stream that is let down in pressure across CMRL expansion device 153 to produce an expanded CMRL stream 154, that is sent back to the shell side of MCHE 164 to provide refrigeration required in the warm bundle 166. The CMRV stream 151 is cooled in the warm bundle 166 and subsequently in a cold bundle 167 of MCHE 164, then reduced in pressure across a CMRV expansion device 155 to produce an expanded CMRV stream 156 that is introduced to the MCHE 164 to provide refrigeration required in the cold bundle 167 and warm bundle 166.

MCHE 164 and precooling heat exchanger 160 can be any exchanger suitable for natural gas cooling and liquefaction such as a coil wound heat exchanger, plate and fin heat exchanger, or a shell and tube heat exchanger. Coil wound heat exchangers are the state of the art exchangers for natural gas liquefaction and include at least one tube bundle comprising a plurality of spiral wound tubes for the flowing process and warm refrigerant streams and a shell space for flowing a cold refrigerant stream.

In the arrangement shown in FIG. 1, the cold end of the first precooling heat exchanger 160 is at a temperature below 20 degrees Celsius, preferably below about 10 degrees Celsius, and more preferably below about 0 degrees Celsius. The cold end of the second precooling heat exchanger 162 is at a temperature below 10 degrees Celsius, preferably below about 0 degrees Celsius, and more preferably below about −30 degrees Celsius. Therefore, the second precooling heat exchanger is at a lower temperature than the first precooling heat exchanger.

A key benefit of a mixed refrigerant cycle is that the composition of the mixed refrigerant stream can be optimized to adjust cooling curves in the heat exchanger and the outlet temperature, to increase the process efficiency. This may be achieved by adjusting the composition of the refrigerant stream for the various stages of the cooling process. For instance, a mixed refrigerant with a high concentration of ethane and heavier components is well suited as a precooling refrigerant while one with a high concentration of methane and nitrogen is well suited as a subcooling refrigerant.

In the arrangement shown in FIG. 1, the composition of the first expanded WMR stream 128 providing refrigeration duty to the first precooling heat exchanger is the same as the composition of the second expanded WMR stream 132 providing refrigeration duty to the second precooling heat exchanger 162. Since the first and second precooling heat exchangers cool to different temperatures, using the same refrigerant composition for both exchangers is inefficient. Further, the inefficiency increases with three or more precooling heat exchangers.

The reduced efficiency leads to an increased power required to produce the same amount of LNG. The reduced efficiency further results in a warmer overall precooling temperature at a fixed amount of available precooling driver power. This shifts the refrigeration load from the precooling system to the liquefaction system, rendering the MCHE larger and increasing the liquefaction power load, which may be undesirable from a capital cost and operability standpoint.

One approach to solving this problem is to have two separate closed loop refrigerant circuits for each stage of precooling. This would require separate mixed refrigerant circuits for the first precooling heat exchanger 160 and the second precooling heat exchanger 162. This would allow the compositions of the two refrigerant streams to be optimized independently and therefore improve efficiency. However, this approach would require separate compression systems for each precooling heat exchanger, which would lead to increased capital cost, footprint, and operational complexity, which is undesirable.

Another problem with the arrangement shown in FIG. 1 is that the power required by the precooling and liquefaction systems may not be equal, requiring a different number of drivers to provide the power. Often the liquefaction system has a higher power requirement than the precooling system due to typical precooling temperatures achievable. In some cases, it may be preferable to achieve a 50-50 power split between precooling and liquefaction system drivers.

Therefore, there is a need for an improved system for liquefying natural gas that provides more balance between the power requirements of the precooling and liquefaction systems and improving the efficiency of both systems, while avoiding an increase in capital cost, footprint or operational complexity.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Some embodiments, as described below and defined by the claims which follow, comprise improvements to the precooling portion of an LNG liquefaction process. Some embodiments satisfy the need in the art by using multiple precooling heat exchange sections in the precooling portion and introducing a stream of the refrigerant used to provide refrigeration duty to the precooling heat exchange sections into a compression system at different pressures. Some embodiments satisfy the need in the art by directing a liquid fraction of a stream of the refrigerant that is intercooled and separated between compression stages of the compression system.

Several aspects of the systems and methods are outlined below.

Aspect 1: A method comprising:

(a) cooling a hydrocarbon feed stream (202), comprising a hydrocarbon fluid, a second refrigerant feed stream (244), comprising a second mixed refrigerant, and at least one first refrigerant stream (216), comprising a first mixed refrigerant, by indirect heat exchange against the first mixed refrigerant in each of a plurality of heat exchange sections of a precooling subsystem to produce a precooled hydrocarbon stream (206), a precooled second refrigerant stream (248) that is at least partially condensed, and a plurality of vaporized first refrigerant streams (210, 218), the precooling subsystem comprising the plurality of heat exchange sections and a compression subsystem;

(b) supplying a first inlet stream (275) to a first precooling heat exchange section (260) at a first inlet pressure and a second inlet stream (216) to the first precooling heat exchange section at a second inlet pressure that is higher than the first inlet pressure, each of the first and second inlet streams comprising the first mixed refrigerant, the first mixed refrigerant having a first inlet composition in the first inlet stream and a second inlet composition in the second inlet stream, the first inlet composition being different from the second inlet composition;

(c) withdrawing a first vaporized first refrigerant stream (218) from the first precooling heat exchange section at a first outlet pressure and a first outlet composition and a second vaporized first refrigerant stream (210) from a second precooling heat exchange section at a second outlet pressure that is lower than the first outlet pressure, and a second outlet composition, each of the first and second vaporized first refrigerant streams comprising one of the plurality of vaporized first refrigerant streams;

(d) at least partially liquefying the precooled hydrocarbon stream (206) in a main heat exchanger (264) by indirect heat exchange against the second mixed refrigerant to produce a first liquefied hydrocarbon stream (208) at a first liquefied hydrocarbon temperature, the second refrigerant having a second refrigerant composition that is different from the first inlet composition, the second inlet composition, the first outlet composition, and the second outlet composition;

(e) expanding the first liquefied hydrocarbon stream (208) to form a reduced pressure first liquefied hydrocarbon stream (203);

(f) separating the reduced pressure first liquefied hydrocarbon stream (203) into a flash gas stream (209) and a second liquefied hydrocarbon stream (205) at a second liquefied hydrocarbon temperature that is less than the first liquefied hydrocarbon temperature;

(g) warming at least a portion of the flash gas stream (209) by indirect heat exchange against at least one flash warming stream to form a recycle stream (285); and (h) combining at least a first portion of the recycle stream (285) with the hydrocarbon feed stream (202) before performing step (a).

Aspect 2: The method of Aspect 1, wherein the second inlet pressure is at least 5 bara higher than the first inlet pressure.

Aspect 3: The method of Aspect 1, wherein the second inlet pressure is at least 10 bara higher than the first inlet pressure.

Aspect 4: The method of any of Aspects 1-3, wherein the first inlet stream composition has less than 75 mole % ethane and lighter hydrocarbons and the second inlet stream composition has more than 40 mole % ethane and lighter hydrocarbons.

Aspect 5: The method of any of Aspects 1-3, wherein the first inlet stream composition has less than 60% ethane and lighter hydrocarbons and the second inlet stream composition has more than 60% of ethane and lighter hydrocarbons.

Aspect 6: The method of any of Aspects 1-5, wherein the second outlet pressure is at least 2 bara lower than the first outlet pressure.

Aspect 7: The method of any of Aspects 1-6, further comprising:

(i) compressing and cooling the recycle stream after performing step (g) and before performing step (h).

Aspect 8: The method of any of Aspects 1-7, wherein step (f) comprises:

(f) separating the reduced pressure first liquefied hydrocarbon stream into a flash gas stream and a second liquefied hydrocarbon stream at a second liquefied hydrocarbon temperature that is less than the first liquefied hydrocarbon temperature, the reduced pressure first liquefied hydrocarbon stream having a first flow rate and the flash gas stream having a second flow rate that is less than 30% of the first flow rate;

Aspect 9: The method of any of Aspects 1-8, wherein step (g) comprises:

(g) warming at least a portion of the flash gas stream by indirect heat exchange against at least one flash warming stream to form a recycle stream, wherein the at least one flash warming stream comprises a portion of the first mixed refrigerant.

Aspect 10: The method of any of Aspects 1-9, wherein step (g) comprises:

(g) warming at least a portion of the flash gas stream by indirect heat exchange against at least one flash warming stream to form a recycle stream, wherein the at least one flash warming stream comprises a portion of the second mixed refrigerant.

Aspect 11: The method of any of Aspects 1-10, wherein step (d) further comprises:

(d) at least partially liquefying the precooled hydrocarbon stream in a main heat exchanger by indirect heat exchange against the second mixed refrigerant to produce a first liquefied hydrocarbon stream at a first liquefied hydrocarbon temperature, the second refrigerant having a second refrigerant composition that is different from the first inlet composition, the second inlet composition, the first outlet composition, and the second outlet composition, the main heat exchanger being a coil-wound heat exchanger.

Aspect 12: The method of any of Aspects 1-10, wherein step (d) further comprises:

(d) at least partially liquefying the precooled hydrocarbon stream in a main heat exchanger by indirect heat exchange against the second mixed refrigerant to produce a first liquefied hydrocarbon stream at a first liquefied hydrocarbon temperature, the second refrigerant having a second refrigerant composition that is different from the first inlet composition, the second inlet composition, the first outlet composition, and the second outlet composition, the main heat exchanger being a coil-wound heat exchanger having no more than one bundle.

Aspect 13: The method of any of Aspects 1-12, wherein the second refrigerant composition comprises more than 20% components lighter than ethane.

Aspect 14: The method of any of Aspects 1-12, wherein the second refrigerant composition comprises more than 40% components lighter than ethane.

Aspect 15: The method of any of Aspects 1-14, wherein step (a) comprises:

(a) cooling a hydrocarbon feed stream, comprising a hydrocarbon fluid, a second refrigerant feed stream, comprising a second mixed refrigerant, and at least one first refrigerant stream, comprising a first mixed refrigerant, by indirect heat exchange against the first mixed refrigerant in each of a plurality of heat exchange sections of a precooling subsystem to produce a precooled hydrocarbon stream, a precooled second refrigerant stream that is fully condensed, and a plurality of vaporized first refrigerant streams, the precooling subsystem comprising the plurality of heat exchange sections and a compression subsystem.

Aspect 16: The method of any of Aspects 1-15, further comprising:

(j) removing a precooling refrigerant stream from a compression stage of the compression subsystem, the precooling refrigerant stream being composed of less than 20% of components lighter than ethane; and (k) separating the precooling refrigerant stream into a first vapor refrigerant stream and the first inlet stream.

Aspect 17: The method of any of Aspects 1-15, further comprising:

(j) removing a precooling refrigerant stream from a compression stage of the compression subsystem, the precooling refrigerant stream being composed of less than 5% of components lighter than ethane; and (k) separating the precooling refrigerant stream into a first vapor refrigerant stream and the first inlet stream.

Aspect 18: The method of any of Aspects 1-17, further comprising:

(l) adjusting at least one parameter selected from the group of (1) the precooled hydrocarbon temperature, (2) the first liquefied hydrocarbon temperature, and (3) the flash gas flow rate, to achieve a first desired ratio of a precooling power requirement to a liquefaction power requirement, the first desired ratio being between between 0.2 and 0.7.

Aspect 19: The method of any of Aspects 1-17, further comprising:

(l) adjusting at least one parameter selected from the group of (1) the precooled hydrocarbon temperature, (2) the first liquefied hydrocarbon temperature, and (3) the flash gas flow rate, to achieve a first desired ratio of a precooling power requirement to a liquefaction power requirement, the first desired ratio being between between 0.3 and 0.6.

Aspect 20: The method of any of Aspects 1-17, further comprising:

(l) adjusting at least one parameter selected from the group of (1) the precooled hydrocarbon temperature, (2) the first liquefied hydrocarbon temperature, and (3) the flash gas flow rate, to achieve a first desired ratio of a precooling power requirement to a liquefaction power requirement, the first desired ratio being between between 0.45 and 0.55.

Aspect 21: A method of cooling a hydrocarbon feed stream, comprising a hydrocarbon fluid, and a second refrigerant feed stream, comprising a second refrigerant, by indirect heat exchange with a first refrigerant in each of a plurality of heat exchange sections of a precooling subsystem and at least partially liquefying the hydrocarbon feed stream in a main heat exchanger, the precooling subsystem comprising the plurality of heat exchange sections and a compression subsystem, wherein the method comprises:

(a) introducing the hydrocarbon feed stream and the second refrigerant feed stream into a warmest heat exchange section of the plurality of heat exchange sections;

(b) cooling the hydrocarbon feed stream and the second refrigerant feed stream in each of the plurality of heat exchange sections to produce a precooled hydrocarbon stream and a precooled second refrigerant stream, the precooled second refrigerant stream being at least partially condensed;

(c) further cooling and at least partially liquefying the precooled hydrocarbon stream and the precooled second refrigerant stream in the main heat exchanger against the second refrigerant to produce a first liquefied hydrocarbon stream and a cooled second refrigerant stream;

(d) withdrawing a low pressure first refrigerant stream from a coldest heat exchange section of the plurality of heat exchange sections and compressing the low pressure first refrigerant stream in at least one compression stage of the compression subsystem;

(e) withdrawing a medium pressure first refrigerant stream from a first heat exchange section (which may be the same as or different to the warmest heat exchange section) of the plurality of heat exchange sections, the first heat exchange section being warmer than the coldest heat exchange section;

(f) combining the low pressure first refrigerant stream and the medium pressure first refrigerant stream to produce a combined first refrigerant stream after steps (d) and (e) have been performed;

(g) withdrawing from the compression system, a high-high pressure first refrigerant stream;

(h) cooling and at least partially condensing the high-high pressure first refrigerant stream in at least one cooling unit to produce a cooled high-high pressure first refrigerant stream;

(i) introducing the cooled high-high pressure first refrigerant stream into a first vapor-liquid separation device to produce a first vapor refrigerant stream and a first liquid refrigerant stream;

(j) introducing the first liquid refrigerant stream into the warmest heat exchange section of the plurality of heat exchange sections;

(k) cooling the first liquid refrigerant stream in the warmest heat exchange section of the plurality of heat exchange sections to produce a first cooled liquid refrigerant stream;

(l) expanding at least a portion of the first cooled liquid refrigerant stream to produce a first expanded refrigerant stream;

(m) introducing the first expanded refrigerant stream into the warmest heat exchange section to provide refrigeration duty to provide a first portion of the cooling of step (b);

(n) compressing at least a portion of the first vapor refrigerant stream of step (i) in at least one compression stage;

(o) cooling and condensing a compressed first refrigerant stream in at least one cooling unit to produce a condensed first refrigerant stream, the at least one cooling unit being downstream from and in fluid flow communication with the at least one compression stage of step (n);

(p) introducing the condensed first refrigerant stream into the warmest heat exchange section of the plurality of heat exchange sections;

(q) cooling the condensed first refrigerant stream in the first heat exchange section and the coldest heat exchange section to produce a first cooled condensed refrigerant stream;

(r) expanding the first cooled condensed refrigerant stream to produce a second expanded refrigerant stream;

(s) introducing the second expanded refrigerant stream into the coldest heat exchange section to provide refrigeration duty to provide a second portion of the cooling of step (b);

(t) expanding the first liquefied hydrocarbon stream to form a reduced pressure first liquefied hydrocarbon stream;

(u) separating the reduced pressure first liquefied hydrocarbon stream into a flash gas stream and a second liquefied hydrocarbon stream;

(v) warming at least a portion of the flash gas stream by indirect heat exchange against at least one flash warming stream to form a recycle stream; and (w) combining at least a first portion of the recycle stream with the hydrocarbon feed stream before performing step (a).

Aspect 22: The method of Aspect 21, wherein the precooled second refrigerant stream is fully condensed after step (b).

Aspect 23: The method of any of Aspects 21-22, further comprising:

(x) withdrawing a first intermediate refrigerant stream from the compression system prior to step (g); and (y) cooling the first intermediate refrigerant stream in at least one cooling unit to produce a cooled first intermediate refrigerant stream and introducing the cooled first intermediate refrigerant stream into the compression system prior to step (g).

Aspect 24: The method of any of Aspects 21-22, further comprising:

(x) withdrawing a high pressure first refrigerant stream from the warmest heat exchange section of the plurality of heat exchange sections; and (y) introducing the high pressure first refrigerant stream into the compression system prior to step (g).

Aspect 25: The method of any of Aspects 23, further comprising:

(z) withdrawing a high pressure first refrigerant stream from the warmest heat exchange section of the plurality of heat exchange sections; and (aa) combining the high pressure first refrigerant stream with the cooled first intermediate refrigerant stream to form a combined first intermediate refrigerant stream, and introducing the combined first intermediate refrigerant stream into the compression system prior to step (g).

Aspect 26: The method of any of Aspects 21-25, wherein step (n) further comprises:

(n) withdrawing a second intermediate refrigerant stream from the compression system and cooling the second intermediate refrigerant stream in at least one cooling unit to produce a cooled second intermediate refrigerant stream.

Aspect 27: The method of Aspect 26, further comprising:

(ab) introducing the cooled second intermediate refrigerant stream into a second vapor-liquid separation device to produce a second vapor refrigerant stream and a second liquid refrigerant stream.

(ac) introducing the second liquid refrigerant stream into the warmest heat exchange section of the plurality of heat exchange sections; and (ad) compressing the second vapor refrigerant stream in at least one compression stage of the compression system prior to producing the compressed first refrigerant stream of step (o).

Aspect 28: The method of any of Aspects 21-27, further comprising:

(ae) after step (v) and before step (w), compressing and cooling the recycle steam.

Aspect 29: The method of any of Aspects 21-28, wherein step (v) further comprises:

(v) warming the flash gas stream by indirect heat exchange against at least one flash warming stream to form a recycle stream and at least one cooled flash warming stream, the at least one flash warming stream comprising at least one stream withdrawn from one selected from the group of the precooling subsystem and the liquefaction subsystem.

Aspect 30: The method of any of Aspects 21-28, wherein step (v) further comprises:

(v) warming the flash gas stream by indirect heat exchange against at least one flash warming stream to form a recycle stream and at least one cooled flash warming stream, the at least one flash warming stream comprising a first portion of the precooled second refrigerant stream and the at least one cooled flash warming stream comprising a cooled first portion of the precooled second refrigerant stream.

Aspect 31: The method of Aspect 30, wherein the first portion is less than 20 mole % of the precooled second refrigerant stream.

Aspect 32: The method of any of Aspects 30, further comprising:

(af) expanding the cooled second refrigerant stream to form an expanded second refrigerant stream;

(ag) introducing the expanded second refrigerant stream into the main heat exchanger to provide refrigeration duty for step (c); and (ah) combining the cooled first portion of the precooled second refrigerant stream with the cooled second refrigerant stream before performing step (af).

Aspect 33: The method of any of Aspects 21-31, wherein step (v) further comprises:

(v) warming the flash gas stream by indirect heat exchange against at least one flash warming stream to form a recycle stream and at least one cooled flash warming stream, the at least one flash warming stream comprising a first portion of the condensed first refrigerant stream and the at least one cooled flash warming stream comprising a cooled first portion of the condensed refrigerant stream.

Aspect 34: The method of Aspect 33, further comprising:

(ai) combining the cooled first portion of the condensed refrigerant stream with the first cooled condensed refrigerant stream before performing step (r).

BRIEF DESCRIPTION OF THE DRAWINGS

Exemplary embodiments will hereinafter be described in conjunction with the appended figures wherein like numerals denote like elements.

DETAILED DESCRIPTION

Figure 1:
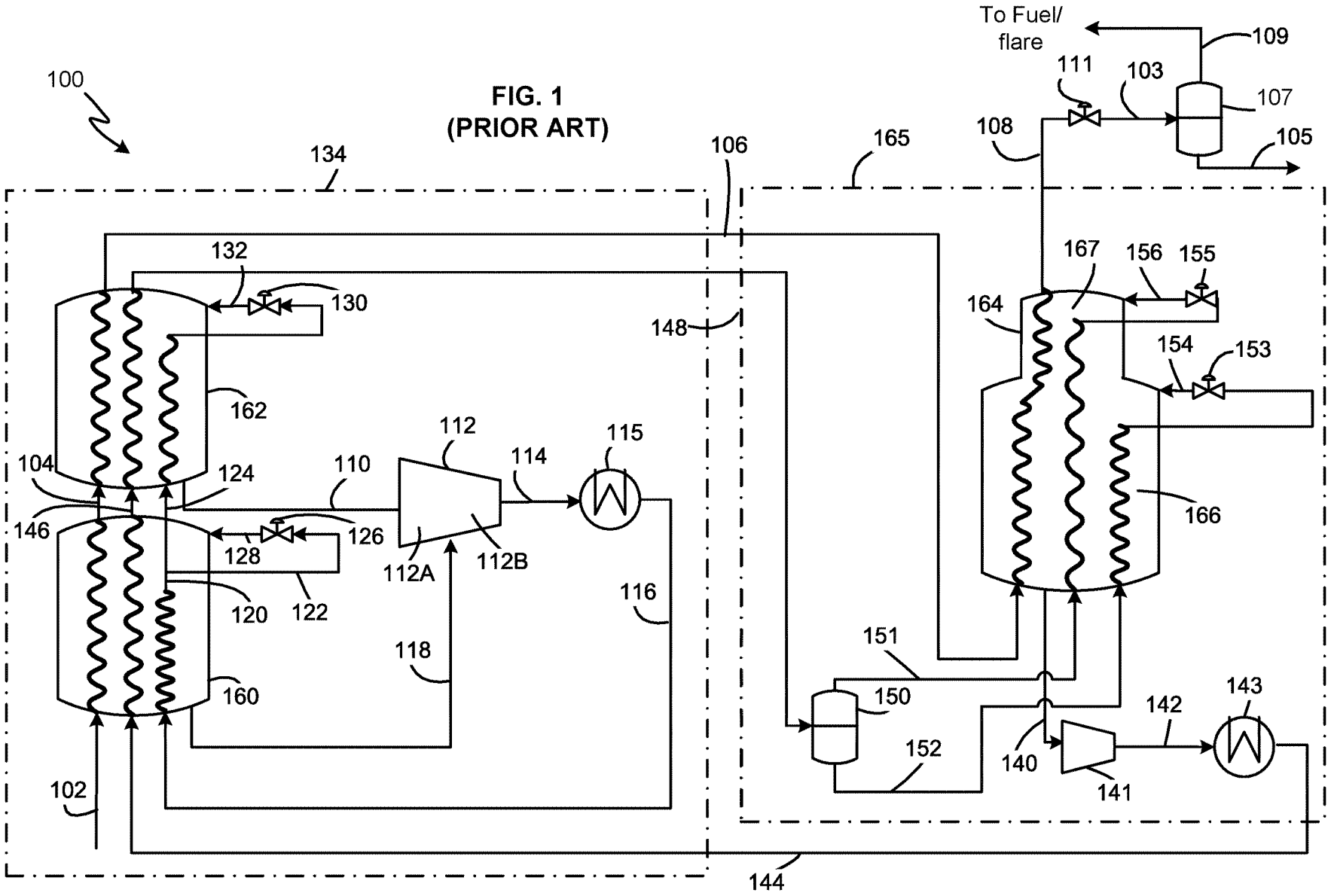
FIG. 1 (PRIOR ART)
FIG. 1 is a schematic flow diagram of a DMR system in accordance with the prior art.

The ensuing detailed description provides preferred exemplary embodiments only, and is not intended to limit the scope of the claims. Rather, the ensuing detailed description of the preferred exemplary embodiments will provide those skilled in the art with an enabling description for implementing the preferred exemplary embodiments. Various changes may be made in the function and arrangement of elements without departing from the spirit and scope thereof.

Reference numerals that are introduced in the specification in association with a drawing figure may be repeated in one or more subsequent figures without additional description in the specification in order to provide context for other features. In the figures, elements that are similar to those of other embodiments are represented by reference numerals increased by a value of 100. For example, the flash drum 207 associated with the embodiment of FIG. 2 corresponds to the flash drum 307 associated with the embodiment of FIG. 3. Such elements should be regarded as having the same function and features unless otherwise stated or depicted herein, and the discussion of such elements may therefore not be repeated for multiple embodiments.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant" (MR), as used in the specification and claims, means a fluid comprising at least two hydrocarbons and for which hydrocarbons comprise at least 80% of the overall composition of the refrigerant.

The term "heavy hydrocarbons", as used in the specification and claims, means hydrocarbons having a molecular weight at least as heavy as ethane.

The terms "bundle" and "tube bundle" are used interchangeably within this application and are intended to be synonymous.

The term "ambient fluid", as used in the specification and claims, means a fluid that is provided to the system at or near ambient pressure and temperature.

In the claims, letters may be used to identify claimed method steps (e.g. (a), (b), and (aa)). These letters are used to aid in referring to the method steps and are not intended to indicate the order in which claimed steps are performed, unless and only to the extent that such order is specifically recited in the claims.

Directional terms may be used in the specification and claims (e.g., upper, lower, left, right, etc.). These directional terms are merely intended to assist in describing exemplary embodiments, and are not intended to limit the scope thereof. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

As used in the specification and claims, the terms "high-high", "high", "medium", "low", and "low-low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

Unless otherwise stated herein, any and all percentages identified in the specification, drawings and claims should be understood to be on a molar percentage basis. Unless otherwise stated herein, any and all pressures identified in the specification, drawings and claims should be understood to mean gauge pressure.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquefied natural gas (LNG), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

As used in the specification and claims, the term "heat exchange section" is defined as having a warm end and a cold end; wherein a separate cold refrigerant stream (other than ambient) is introduced at the cold end of the heat exchange section and a warm first refrigerant stream is withdrawn from the warm end of the heat exchange section. Multiple heat exchange sections may optionally be contained within a single or multiple heat exchangers. In case of a shell and tube heat exchanger or a coil wound heat exchanger, the multiple heat exchange sections may be contained within a single shell.

As used in the specification and claims, the "temperature" of a heat exchange section is defined by the outlet temperature of the hydrocarbon stream from that heat exchange section. For example, the terms "warmest", "warmer", "coldest", and "colder" when used with respect to a heat exchange section represent the outlet temperature of the hydrocarbon stream from that heat exchange section relative to the outlet temperatures of the hydrocarbon stream of other heat exchange sections. For example, a warmest heat exchange section is intended to indicate a heat exchange section having a hydrocarbon stream outlet temperature warmer than the hydrocarbon stream outlet temperature in any other heat exchange sections.

As used in the specification and claims, the term "compression system" is defined as one or more compression stages. For example, a compression system may comprise multiple compression stages within a single compressor. In an alternative example, a compression system may comprise multiple compressors.

Unless otherwise stated herein, introducing a stream at a location is intended to mean introducing substantially all of the said stream at the location. All streams discussed in the specification and shown in the drawings (typically represented by a line with an arrow showing the overall direction of fluid flow during normal operation) should be understood to be contained within a corresponding conduit. Each conduit should be understood to have at least one inlet and at least one outlet. Further, each piece of equipment should be understood to have at least one inlet and at least one outlet.

Table 1 defines a list of acronyms employed throughout the specification and drawings as an aid to understanding the described embodiments.

TABLE 1

| | | | |
|---|---|---|---|
| SMR | Single Mixed Refrigerant | MR | Mixed Refrigerant |

TABLE 1-continued

| | | | |
|---|---|---|---|
| DMR | Dual Mixed Refrigerant | CMR | Cold Mixed Refrigerant |
| C3MR | Propane-precooled Mixed Refrigerant | WMR | Warm Mixed Refrigerant |
| LNG | Liquid Natural Gas | MRL | Mixed Refrigerant Liquid |
| MCHE | Main Cryogenic Heat Exchanger | MRV | Mixed Refrigerant Vapor |

Systems and methods are described herein for increasing capacity and efficiency of natural gas liquefaction processes having a mixed refrigerant precooling system with multiple pressure levels comprising cooling the compressed mixed refrigerant stream and separating the cooled compressed mixed refrigerant stream into a vapor and liquid portion. The liquid portion provides refrigeration duty to a first precooling heat exchanger. The vapor portion is further compressed, cooled, and condensed, and used to provide refrigeration duty to a second precooling heat exchanger. Further, the systems and methods comprise liquefying the precooled natural gas to produce an LNG stream, lowering the pressure of the LNG stream to produce a flash gas stream, and recycling at least a portion of the flash gas stream to the suction of the first precooling heat exchanger.

Figure 2:
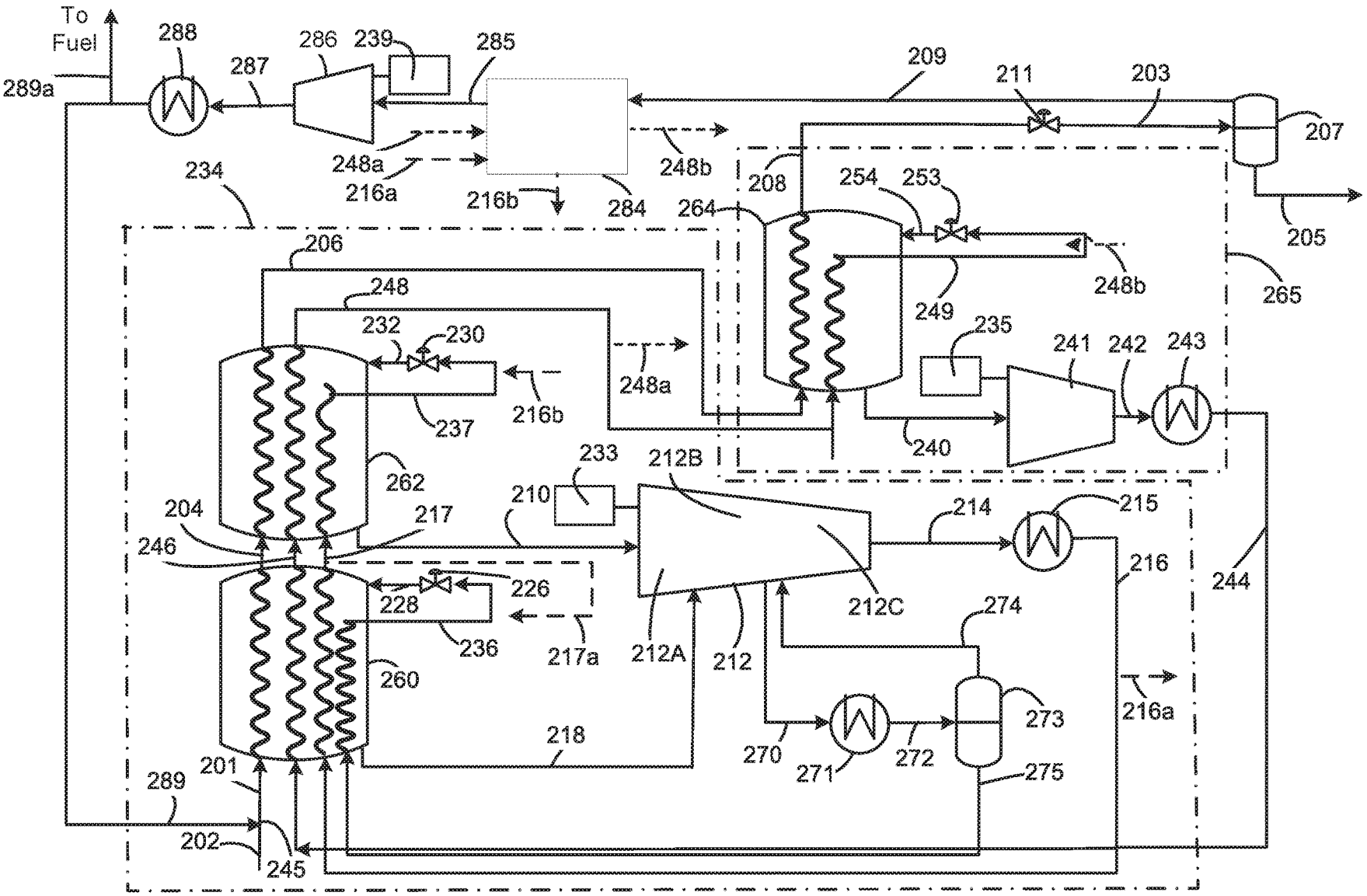
FIG. 2 is a schematic flow diagram of a precooling system of a DMR system in accordance with a first exemplary embodiment.

FIG. 2 shows a first exemplary embodiment. For simplicity, in FIG. 2 and subsequent figures, only the precooling system 234 is shown in detail and the liquefaction system is shown in a simplified manner. The details of the liquefaction system 165 in FIG. 1 are applicable in any of the subsequent figures.

A low pressure WMR stream 210 (also referred to as a second vaporized first refrigerant stream) is withdrawn from the warm end of the shell side of a second precooling heat exchanger 262 and compressed in a first compression stage 212A of a WMR compressor 212. A medium pressure WMR stream 218 (also referred to as a first vaporized first refrigerant stream) is withdrawn from the warm end of the shell side of a first precooling heat exchanger 260 and introduced as a side-stream into the WMR compressor 212, where it mixes with a compressed stream (not shown) from the first compression stage 212A. Further, the compressed stream from the first compression stage 212A may be cooled against ambient prior to mixing with the medium pressure WMR stream 218. The mixed stream (not shown) is compressed in a second WMR compression stage 212B of the WMR compressor 212 to produce a high-high pressure WMR stream 270. Any liquid present in the low pressure WMR stream 210 and the medium pressure WMR stream 218 are removed in vapor-liquid separation devices (not shown) prior to introduction in the WMR compressor 212.

The high-high pressure WMR stream 270 may be at a pressure between 5 bara and 40 bara, and preferably between 15 bara and 30 bara. The high-high pressure WMR stream 270 is withdrawn from the WMR compressor 212, and cooled and partially condensed in a high-high pressure WMR intercooler 271 to produce a cooled high-high pressure WMR stream 272. The high-high pressure WMR intercooler 271 may be any suitable type of cooling unit, such as an ambient cooler that uses air or water, and may comprise one or more heat exchangers. The cooled high-high pressure WMR stream 272 may have a vapor fraction between 0.2 and 0.8, preferably between 0.3 and 0.7, and more preferably between 0.4 and 0.6. The cooled high-high pressure WMR stream 272 is phase separated in a first WMR vapor-liquid separation device 273 to produce a first WMRV stream 274 and a first WMRL stream 275.

The first WMRL stream 275 contains less than 75% of ethane and lighter hydrocarbons, preferably less than 70% of ethane and lighter hydrocarbons, and more preferably less than 60% of ethane and lighter hydrocarbons. The first WMRV stream 274 contains more than 40% of ethane and lighter hydrocarbons, preferably more than 50% of ethane and lighter hydrocarbons, and more preferably more than 60% of ethane and lighter hydrocarbons. The first WMRL stream 275 is introduced into the first precooling heat exchanger 260 to be cooled in a tube circuit to produce a first further cooled WMR stream 236 (also referred to as a cooled liquid refrigerant stream) that is expanded in a first WMR expansion device 226 (also referred to as a pressure letdown device) to produce a first expanded WMR stream 228 that provides refrigeration duty to the first precooling heat exchanger 260. Examples of suitable expansion devices include a Joule-Thomson (J-T) valve and a turbine.

The first WMRV stream 274 is introduced into the WMR compressor 212 to be compressed in a third WMR compression stage 212C of WMR compressor 212 to produce a compressed WMR stream 214. The compressed WMR stream 214 is cooled and preferably condensed in a WMR aftercooler 215 to produce a first cooled compressed WMR stream 216 (also referred to as a compressed first refrigerant stream or a second inlet stream), which is introduced into the first precooling heat exchanger 260 to be further cooled in a tube circuit to produce a first precooled WMR stream 217. The molar composition of the first cooled compressed WMR stream 216 is the same as that of the first WMRV stream 274. A portion of the first cooled compressed WMR stream 216 may be removed from the precooling system 234 as a portion of the WMR stream 216*a* (also referred to as a flash warming stream), cooled in a flash gas exchanger 284 to produce a cooled portion of the WMR stream 216*b*, which may be returned to the precooling system 234 upstream from expansion in the second WMR expansion device 230 or the first WMR expansion device 226 or any other suitable location. The portion of the WMR stream 216*a* is preferably less than about 20 mole % of the first cooled compressed WMR stream 216, and preferably between 2 mole % and 10 mole % of the first cooled compressed WMR stream 216.

The first precooled WMR stream 217 is introduced into the second precooling heat exchanger 262 to be further cooled in a tube circuit to produce a second further cooled WMR stream 237. The second further cooled WMR stream 237 is expanded in a second WMR expansion device 230 (also referred to as a pressure letdown device) to produce a second expanded WMR stream 232, which is introduced into the shell side of the second precooling heat exchanger 262 to provide refrigeration duty.

The first cooled compressed WMR stream 216 may be fully condensed or partially condensed. In a preferred embodiment, the first cooled compressed WMR stream 216 is fully condensed. The cooled high-high pressure WMR stream 272 may comprise less than 20% of components lighter than ethane, preferably less than 10% of components lighter than ethane, and more preferably less than 5% of components lighter than ethane, and is referred to as the "precooling refrigerant composition". Therefore, it is possible to fully condense the compressed WMR stream 214 to produce a fully condensed first cooled compressed WMR stream 216 without needing to compress to very high pressure. The compressed WMR stream 214 may be at a pressure between 300 psia (21 bara) and 600 psia (41 bara), and preferably between 400 psia (28 bara) and 500 psia (35 bara). If the second precooling heat exchanger 262 was a liquefaction heat exchanger used to fully liquefy the natural gas, the cooled high-high pressure WMR stream 272 would have a higher concentration of nitrogen and methane and therefore the pressure of the compressed WMR stream 214 would have to be higher in order for the first cooled compressed WMR stream 216 to be fully condensed. Since this may not be possible to achieve, the first cooled compressed WMR stream 216 would not be fully condensed and would contain significant vapor concentration that may need to be liquefied separately.

A pretreated feed stream 202 (referred to the claims as a hydrocarbon feed stream) is mixed with a recycle stream 289 to produce a mixed feed stream 201, which is cooled in a first precooling heat exchanger 260 to produce a first precooled natural gas stream 204 at a temperature below 20 degrees Celsius, preferably below about 10 degrees Celsius, and more preferably below about 0 degrees Celsius. As is known in the art, the feed stream 202 has preferably been pretreated to remove moisture and other impurities such as acid gases, mercury, and other contaminants. The first precooled natural gas stream 204 is cooled in a second precooling heat exchanger 262 to produce the second precooled natural gas stream 206 at a temperature below 10 degrees Celsius, preferably below about 0 degrees Celsius, and more preferably below about −30 degrees Celsius, depending on ambient temperature, natural gas feed composition and pressure. The second precooled natural gas stream 206 may be partially condensed.

A compressed cooled CMR stream 244 (also referred to as a second refrigerant feed stream) is cooled in the first precooling heat exchanger 260 to produce a first precooled CMR stream 246. The compressed cooled CMR stream 244 may comprise more than 20% of components lighter than ethane, preferably more than 30% of components lighter than ethane, and, more preferably, more than 40% of components lighter than ethane and is referred to as the "liquefaction refrigerant composition". The first precooled CMR stream 246 is cooled in a second precooling heat exchanger 262 to produce a second precooled CMR stream 248 (also referred to as precooled second refrigerant stream).

The second precooled natural gas stream 206 and the second precooled CMR stream 248 are sent to the liquefaction system. The second precooled natural gas stream is liquefied and optionally subcooled in the MCHE 264 to produce the first LNG stream 208 (referred to as a liquefied hydrocarbon stream in the claims) at a temperature between about −160 degrees Celsius and about −70 degrees Celsius, preferably between about −150 degrees Celsius and about −100 degrees Celsius. The second precooled CMR stream 248 is preferably fully condensed and subcooled in the MCHE 264, resulting in a cold CMR stream that is let down in pressure across CMRL expansion device 253 to produce an expanded CMRL stream 254, that is sent back to the shell side of MCHE 264 to provide the required refrigeration. The MCHE 264 is shown as a single bundle exchanger, however multiple bundles or exchangers may be used. Further, the second precooled CMR stream 248 may be two-phase and it may be beneficial to separate it into vapor and liquid phases and utilize separate cooling circuits in the MCHE as well as separate expansion devices, as shown in FIG. 1.

A warm low pressure CMR stream 240 is withdrawn from the warm end of the shell side of the MCHE 264, sent through a suction drum (not shown) to separate out any liquids and the vapor stream is compressed in CMR compressor 241 to produce a compressed CMR stream 242. The warm low pressure CMR stream 220 is typically withdrawn at a temperature at or near WMR precooling temperature and preferably less than about −30 degree Celsius and at a pressure of less than 10 bara (145 psia). The compressed CMR stream 242 is cooled in a CMR aftercooler 243, typically against ambient, to produce a compressed cooled CMR stream 244. Additional phase separators, compressors, and aftercoolers may be present. The compressed cooled CMR stream 244 is then introduced into the first precooling heat exchanger 260.

The first LNG stream 208 may be let down in pressure by passing it through the LNG pressure letdown device 211 to produce the reduced pressure LNG stream 203, which is then sent to the flash drum 207 to produce a flash gas stream 209 and a second LNG stream 205. The pressure of the reduced pressure LNG stream 203 may be less than between about 20 bara and preferably less than about 10 bara and more preferably less than about 5 bara. Depending on the temperature of the first LNG stream and the pressure of the reduced pressure LNG stream 203, the flowrate of the flash gas stream 209 may be varied. Typically, a colder first LNG stream and/or a higher pressure reduced pressure LNG stream 203 will lead to lower flash gas stream 209 flowrate. The flowrate of the flash gas stream 209 may be less than about 30% of the flowrate of the reduced pressure LNG stream 203 and preferably less than about 20% of the flowrate of the reduced pressure LNG stream 203. The second LNG stream 205 may be letdown to storage pressure and sent to an LNG storage tank (not shown). The flash gas stream 209 may also include any boil-off gas (BOG) produced in the storage tank. The flash gas stream 209 may be warmed in a flash gas exchanger 284 to produce a warmed flash gas stream 285. The warmed flash gas stream 285 may be compressed in a flash gas compressor 286 to produce a compressed flash gas stream 287, which is cooled in a flash gas cooler 288 to produce the recycle stream 289, and optionally a fuel gas stream 289*a* to be used as fuel in the facility. The flash gas compressor 286 is preferably driven by a separate, dedicated driver 239, such as an electric motor. The flowrate of the fuel gas stream 289*a* may be less than about 30% of the flowrate of the flash gas stream 209 and preferably less than about 20% of the flowrate of the flash gas stream 209. The recycle stream 289 is mixed with the pretreated feed stream 202 at recycle stream mixing point 245. In an alternative embodiment, the recycle stream 289 may not be mixed with the pretreated feed stream 202 and may be precooled and liquefied through separate dedicated circuits in the precooling and liquefaction systems.

A portion of CMR stream 248*a* may be removed from the liquefaction system 265 at any location, such as from the second precooled CMR stream 248. The portion of the CMR stream 248*a* (also referred to as a flash warming stream) is preferably less than about 20 mole % of the second precooled CMR stream 248, and preferably between 5 mole % and 15 mole % of the second precooled CMR stream 248. The portion of CMR stream 248*a* may be cooled against the flash gas stream 209 to produce a cooled portion of CMR stream 248*b* (also referred to as a cooled flash warming stream), which may be returned to the liquefaction system 265 at a suitable location, such as upstream of the CMRL expansion device 253. The portion of the WMR stream 216*a* may also be cooled against the flash gas stream 209 to produce the cooled portion of the WMR stream 216*b* (also referred to as a cooled flash warming stream).

Although FIG. 2 shows two precooling heat exchangers and two pressure levels in the precooling circuit, any number of precooling heat exchangers and pressure levels may be utilized. The precooling heat exchangers are shown to be coil wound heat exchangers in FIG. 2. However, they may be plate and fin heat exchangers, shell and tube heat exchangers, or any other heat exchangers suitable for precooling natural gas. Further, the heat exchangers may be manufactured by any method, including additive manufacturing and three-dimensional printing.

The two precooling heat exchangers (260, 262) of FIG. 2 may be two heat exchange sections within a single heat exchanger. Alternatively, the two precooling heat exchangers may be two heat exchangers, each with one or more heat exchange sections.

Optionally, a portion of the first precooled WMR stream 217 may be mixed with the first further cooled WMR stream 236 prior to expansion in the first WMR expansion device 226 to provide supplemental refrigeration to the first precooling heat exchanger 260 (shown with dashed line 217*a*).

Although FIG. 2 shows three compression stages, any number of compression stages may be performed. Further, compression stages 212A, 212B, and 212C may be part of a single compressor body, or be multiple separate compressors. Additionally, intermediate cooling heat exchangers may be provided between the stages. The WMR compressor 212, CMR compressor 241, and/or the flash gas compressor 286 may be any type of compressor such as centrifugal, axial, positive displacement, or any other compressor type and may comprise any number of stages with optional inter-cooling.

In the embodiment shown in FIG. 2, the warmest heat exchange section is the first precooling heat exchanger 260 and the coldest heat exchange section is the second precooling heat exchanger 262.

In a preferred embodiment, the second precooled CMR stream 248 may be fully condensed, eliminating the need for the CMR phase separator 150 in FIG. 1 as well as the CMRV expansion device 155 in FIG. 1. In this embodiment, the main cryogenic heat exchanger 164 in FIG. 1 may be a single bundle heat exchanger with two warm feed streams: the second precooled natural gas stream 206 and the second precooled CMR stream 248.

A benefit of the arrangement shown in FIG. 2 is that the WMR refrigerant stream is split into two portions: the first WMRL stream 275 with heavy hydrocarbons and the first WMRV stream 274 with lighter components. The first precooling heat exchanger 260 is cooled using the first WMRL stream 275 and the second precooling heat exchanger 262 is cooled using the first WMRV stream 274. Since the first precooling heat exchanger 260 cools to a warmer temperature than the second precooling heat exchanger 262, the heavier hydrocarbons in the WMR are required in the first precooling heat exchanger 260 while the lighter hydrocarbons in the WMR are required to provide deeper cooling in the second precooling heat exchanger 262. Therefore, the arrangement shown in FIG. 2 leads to improved process efficiency, and therefore lowers the required precooling power for the same amount of precooling duty. At fixed precooling power and feed flowrate, it enables colder precooling temperatures. This arrangement also makes it possible to shift the refrigeration load into the precooling system from the liquefaction system, thereby reducing the power requirement in the liquefaction system and reducing the size of the MCHE. Further, the WMR composition and pressures at various compression stages of the WMR compressor 212 may be optimized to result in an optimal vapor fraction in the cooled high-high pressure WMR stream 272, leading to further improvement in process efficiency. In a preferred embodiment, the three compression stages of WMR compressor 212 (212A, 212B, and 212C) are performed in a single compressor body, thereby minimizing capital cost.

The arrangement of FIG. 2 results in the composition of the first WMRL stream 275 (also referred to as a first inlet stream) having a higher percentage of heavy hydrocarbons on a mole basis than the first cooled compressed WMR stream 216. In addition, the pressure of the first WMRL stream 275 is lower than the pressure of the first cooled compressed WMR stream 216. Preferably the pressure of the first WMRL stream 275 is at least 5 bara lower than the pressure of the first cooled compressed WMR stream 216 and preferably 10 bara lower than the pressure of the first cooled compressed WMR stream 216. Similarly, the arrangement of FIG. 2 also results in the pressure of the low pressure WMR stream 210 being lower than the pressure of the medium pressure WMR stream 218. Preferably the pressure of the low pressure WMR stream 210 is at least 2 bara lower than the pressure of the medium pressure WMR stream 218.

Additionally, the embodiment shown in FIG. 2 allows the temperature of the first LNG stream 208 to be warmer than the prior art for the same LNG product temperature (i.e., the temperature of the second LNG stream 205). This is because a larger amount of flash gas is produced than in prior art systems. The liquefaction and subcooling duty is reduced, lowering the overall power requirement for the facility. Therefore, the embodiment enables balancing the power requirements for the precooling and liquefaction systems and in a preferred embodiment, results in a 50-50 power split between precooling and liquefaction systems.

Further, the embodiment of FIG. 2 minimizes the need for feed gas flaring in the facility and therefore lowers the amount of feed gas lost to flare. This increases overall plant efficiency and makes the facility more environmentally friendly, which is a valuable improvement over prior art processes.

Figure 3:
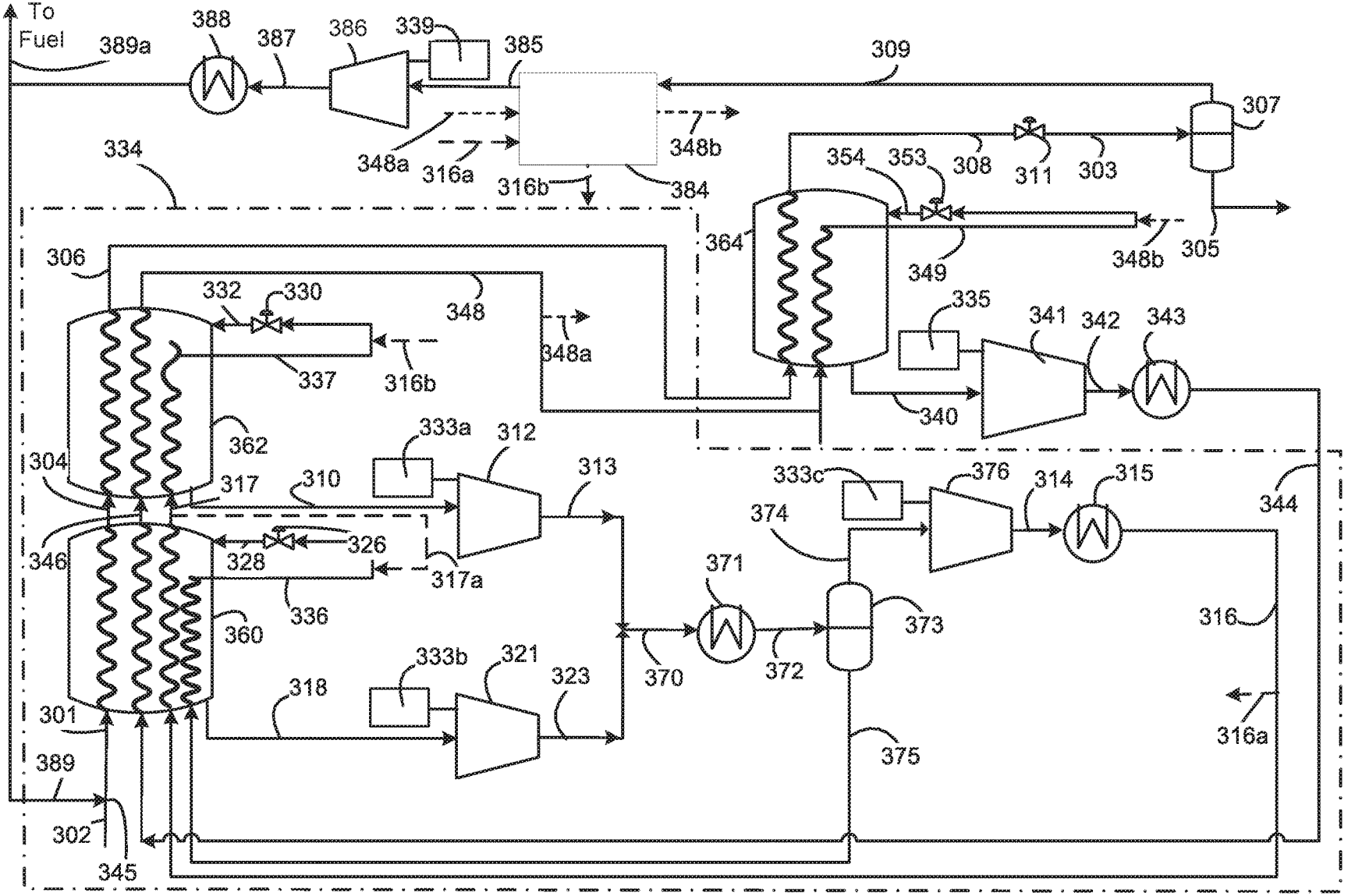
FIG. 3 is a schematic flow diagram of a precooling system of a DMR system in accordance with a second exemplary embodiment.

FIG. 3 shows a second exemplary embodiment. The low pressure WMR stream 310 is compressed in a low pressure WMR compressor 312 to produce a first high pressure WMR stream 313. A medium pressure WMR stream 318 is compressed in a medium pressure WMR compressor 321 to produce a second high pressure WMR stream 323. The first high pressure WMR stream 313 and the second high pressure WMR stream 323 are mixed to produce a high-high pressure WMR stream 370 at a pressure between 5 bara and 25 bara, and preferably between 10 bara and 20 bara. The high-high pressure WMR stream 370 is cooled in a high-high pressure WMR intercooler 371 to produce the cooled high-high pressure WMR stream 372. The high-high pressure WMR intercooler 371 may be an ambient cooler that cools against air or water and may comprise multiple heat exchangers. The cooled high-high pressure WMR stream 372 may have a vapor fraction between 0.3 and 0.9, preferably between 0.4 and 0.8, and more preferably between 0.45 and 0.6. The cooled high-high pressure WMR stream 372 may comprise less than 20% of components lighter than ethane, preferably less than 10% of components lighter than ethane, and more preferably less than 5% of components lighter than ethane, and is referred to as the "precooling refrigerant composition". The cooled high-high pressure WMR stream 372 is phase separated in a first WMR vapor-liquid separation device 373 to produce a first WMRV stream 374 and a first WMRL stream 375. The first WMRL stream 375 contains less than 75% of ethane and lighter hydrocarbons, preferably less than 70% of ethane and lighter hydrocarbons, and more preferably less than 60% of ethane and lighter hydrocarbons. The first WMRV stream 374 contains more than 40% of ethane and lighter hydrocarbons, preferably more than 50% of ethane and lighter hydrocarbons, and more preferably more than 60% of ethane and lighter hydrocarbons. The first WMRL stream 375 is introduced into the first precooling heat exchanger to be cooled to produce a first further cooled WMR stream 336. The first further cooled WMR stream 336 is expanded in a first WMR expansion device 326 to produce a first expanded WMR stream 328 that provides refrigeration duty to the first precooling heat exchanger 360.

The first WMRV stream 374 is compressed in a high pressure WMR compressor 376 to produce a compressed WMR stream 314. The compressed WMR stream 314 is cooled and preferably condensed in a WMR aftercooler 315 to produce a first cooled compressed WMR stream 316. The molar composition of the first cooled compressed WMR stream 316 is the same as that of the first WMRV stream 374. A portion of the first cooled compressed WMR stream 316 may be removed from the precooling system 334 as a portion of the WMR stream 316*a*, cooled in a flash gas exchanger 384 to produce a cooled portion of the WMR stream 316*b*, which may be returned to the precooling system 334 prior to expansion in the second WMR expansion device 330 or the first WMR expansion device 326 or any other suitable location. The remainder of the first cooled compressed WMR stream 316 is introduced into the first precooling heat exchanger 360 to be further cooled in a tube circuit to produce a first precooled WMR stream 317. The first precooled WMR stream 317 is introduced into the second precooling heat exchanger 362 to be further cooled to produce a second further cooled WMR stream 337. The second further cooled WMR stream 337 is expanded in a second WMR expansion device 330 to produce a second expanded WMR stream 332, which is introduced into the shell side of the second precooling heat exchanger 362 to provide refrigeration duty.

The low pressure WMR compressor 312, the medium pressure WMR compressor 321, and the high pressure WMR compressor 376 may comprise multiple compression stages with optional intercooling heat exchangers. The high pressure WMR compressor 376 may be part of the same compressor body as the low pressure WMR compressor 312 or the medium pressure WMR compressor 321. The compressors may be centrifugal, axial, positive displacement, or any other compressor type. Further, instead of cooling the high-high pressure WMR stream 370 in the high-high pressure WMR intercooler 371, the first high pressure WMR stream 313 and the second high pressure WMR stream 323 may be individually cooled in separate heat exchangers (not shown). The first WMR vapor-liquid separation device 373 may be a phase separator. In an alternate embodiment, the first WMR vapor-liquid separation device 373 may be a distillation column or a mixing column with a suitable cold stream introduced into the column.

Optionally, a portion of the first precooled WMR stream 317 may be mixed with the first further cooled WMR stream 336 prior to expansion in the first WMR expansion device 326 to provide supplemental refrigeration to the first precooling heat exchanger 360 (shown with dashed line 317*a*). A further embodiment is a variation of FIG. 3 with a three pressure precooling circuit. This embodiment involves a third compressor in addition to the low pressure WMR compressor 312 and the medium pressure WMR compressor 321. In this embodiment, the drivers for the compressors 312, 321, 376 of the pre-cooling subsystems are labeled as drivers 333*a*, 333*b*, and 333*c* respectively.

A pretreated feed stream 302 (also referred as a hydrocarbon feed stream) is mixed with a recycle stream 389 to produce a mixed feed stream 301, which is cooled in a first precooling heat exchanger 360 to produce a first precooled natural gas stream 304 at a temperature below 20 degrees Celsius, preferably below about 10 degrees Celsius, and more preferably below about 0 degrees Celsius. As is known in the art, the feed stream 302 has preferably been pretreated to remove moisture and other impurities such as acid gases, mercury, and other contaminants. The first precooled natural gas stream 304 is cooled in a second precooling heat exchanger 362 to produce the second precooled natural gas stream 306 at a temperature below 10 degrees Celsius, preferably below about 0 degrees Celsius, and more preferably below about −30 degrees Celsius, depending on ambient temperature, natural gas feed composition and pressure. The second precooled natural gas stream 306 may be partially condensed.

A compressed cooled CMR stream 344 (also referred to as a second refrigerant feed stream) is cooled in the first precooling heat exchanger 360 to produce a first precooled CMR stream 346. The compressed cooled CMR stream 344 may comprise more than 20% of components lighter than ethane, preferably more than 30% of components lighter than ethane, and, more preferably, more than 40% of components lighter than ethane and is referred to as the "liquefaction refrigerant composition". The first precooled CMR stream 346 is cooled in a second precooling heat exchanger 362 to produce a second precooled CMR stream 348 (also referred to as precooled second refrigerant stream).

The second precooled natural gas stream 306 and the second precooled CMR stream 348 are sent to the liquefaction system 365. The second precooled natural gas stream is liquefied and optionally subcooled in the MCHE 364 to produce the first LNG stream 308 (referred to as a liquefied hydrocarbon stream in the claims) at a temperature between about −160 degrees Celsius and about −70 degrees Celsius, preferably between about −150 degrees Celsius and about −100 degrees Celsius. The second precooled CMR stream 348 is preferably fully condensed and subcooled in the MCHE 364, resulting in a cold stream that is let down in pressure across CMRL expansion device 353 to produce an expanded CMRL stream 354, that is sent back to the shell side of MCHE 364 to provide refrigeration required. The MCHE 364 is shown as a single bundle exchanger, however multiple bundles or exchangers may be used. Further, the second precooled CMR stream 348 may be two-phase and it may be beneficial to separate it into vapor and liquid phases and utilize separate cooling circuits in the MCHE as well as separate expansion devices, as shown in FIG. 1.

A warm low pressure CMR stream 340 is withdrawn from the warm end of the shell side of the MCHE 364, sent through a suction drum (not shown) to separate out any liquids and the vapor stream is compressed in CMR compressor 341 to produce a compressed CMR stream 342. The warm low pressure CMR stream 320 is typically withdrawn at a temperature at or near WMR precooling temperature and preferably less than about −30 degree Celsius and at a pressure of less than 10 bara (145 psia). The compressed CMR stream 342 is cooled in a CMR aftercooler 343, typically against ambient air, to produce a compressed cooled CMR stream 344. Additional phase separators, compressors, and aftercoolers may be present. The compressed cooled CMR stream 344 is then introduced into the first precooling heat exchanger 360.

The first LNG stream 308 may be let down in pressure by passing it through the LNG pressure letdown device 311 to produce the reduced pressure LNG stream 303, which is then sent to the flash drum 307 to produce a flash gas stream 309 and a second LNG stream 305. The second LNG stream 305 may be letdown to storage pressure and sent to an LNG storage tank (not shown). The flash gas stream 309 may also include any boil-off gas (BOG) produced in the storage tank. The flash gas stream 309 may be warmed in a flash gas exchanger 384 to produce a warmed flash gas stream 385. The warmed flash gas stream 385 may be compressed in a flash gas compressor 386 to produce a compressed flash gas stream 387, which is cooled in a flash gas cooler 388 to produce the recycle stream 389, and optionally a fuel gas stream **389*a* to be used as fuel in the facility. The recycle stream 389 is mixed with the pretreated feed stream 302**.

A portion of CMR stream **348*a* may be removed from the liquefaction system 365 at any location, such as from the second precooled CMR stream 348. The portion of CMR stream 348*a* may be cooled against the flash gas stream 309 to produce a cooled portion of CMR stream 348*b*, which may be returned to the liquefaction system 365 at a suitable location, such as upstream of the CMRL expansion device 353. The portion of the WMR stream 316*a* may also be cooled against the flash gas stream 309 to produce the cooled portion of the WMR stream 316*b***.

In the embodiment shown in FIG. 3, the warmest heat exchange section is the first precooling heat exchanger 360 and the coldest heat exchange section is the second precooling heat exchanger 362. The WMR compressor 312, CMR compressor 341, and/or the flash gas compressor 386 may be any type of compressor such as centrifugal, axial, positive displacement, or any other compressor type and may comprise any number of stages with optional inter-cooling.

As in FIG. 2, in a preferred embodiment, the second precooled CMR stream 348 may be fully condensed, eliminating the need for the CMR phase separator 150 in FIG. 1 as well as the CMRV expansion device 155 in FIG. 1. In this embodiment, the main cryogenic heat exchanger 164 in FIG. 1 may be a single bundle heat exchanger with two warm feed streams: the second precooled natural gas stream 306 and the second precooled CMR stream 348.

Similar to FIG. 2, a benefit of the arrangement shown in FIG. 3 is that the WMR refrigerant stream is split into two portions: the first WMRL stream 375 with heavier hydrocarbons and the first WMRV stream 374 with lighter hydrocarbons. Since the first precooling heat exchanger 360 cools to a warmer temperature than the second precooling heat exchanger 362, the heavier hydrocarbons in the WMR are required in the first precooling heat exchanger 260 while the lighter hydrocarbons in the WMR are required to provide deeper cooling in the second precooling heat exchanger 262. Therefore, the arrangement shown in FIG. 3 leads to improved process efficiency and therefore lower required precooling power, as compared to FIG. 1 of the prior art. This arrangement also makes it possible to shift refrigeration load into the precooling system from the liquefaction system, thereby reducing the power requirement in the liquefaction system and reducing the size of the MCHE. Further, the WMR composition and compression pressures may be optimized to result in an optimal vapor fraction for the cooled high-high pressure WMR stream 372, leading to further improvement in process efficiency.

Additionally, similar to FIG. 2, the embodiment shown in FIG. 3 allows the temperature for the first LNG stream 308 to be warmer than the prior art for the same temperature of the second LNG stream 305 in tank. This is because a larger amount of flash gas is produced than for the prior art cases. Therefore, the liquefaction and subcooling duty is reduced, lowering the overall power requirement for the facility. The embodiment also allows for almost equal power requirements for the precooling and liquefaction system.

A drawback of the arrangement shown in FIG. 3 compared to that in FIG. 2 is that it requires at least two compressor bodies due to parallel compression of the WMR. However, it is beneficial in scenarios where multiple compression bodies are present. In the embodiment shown in FIG. 3, the low pressure WMR stream 310 and the medium pressure WMR stream 318 are compressed in parallel, which is beneficial in scenarios where compressor size limitations are a concern. The low pressure WMR compressor 312 and the medium pressure WMR compressor 321 may be designed independently and may have different numbers of impellers, pressure ratios, and other design characteristics.

Figure 4:
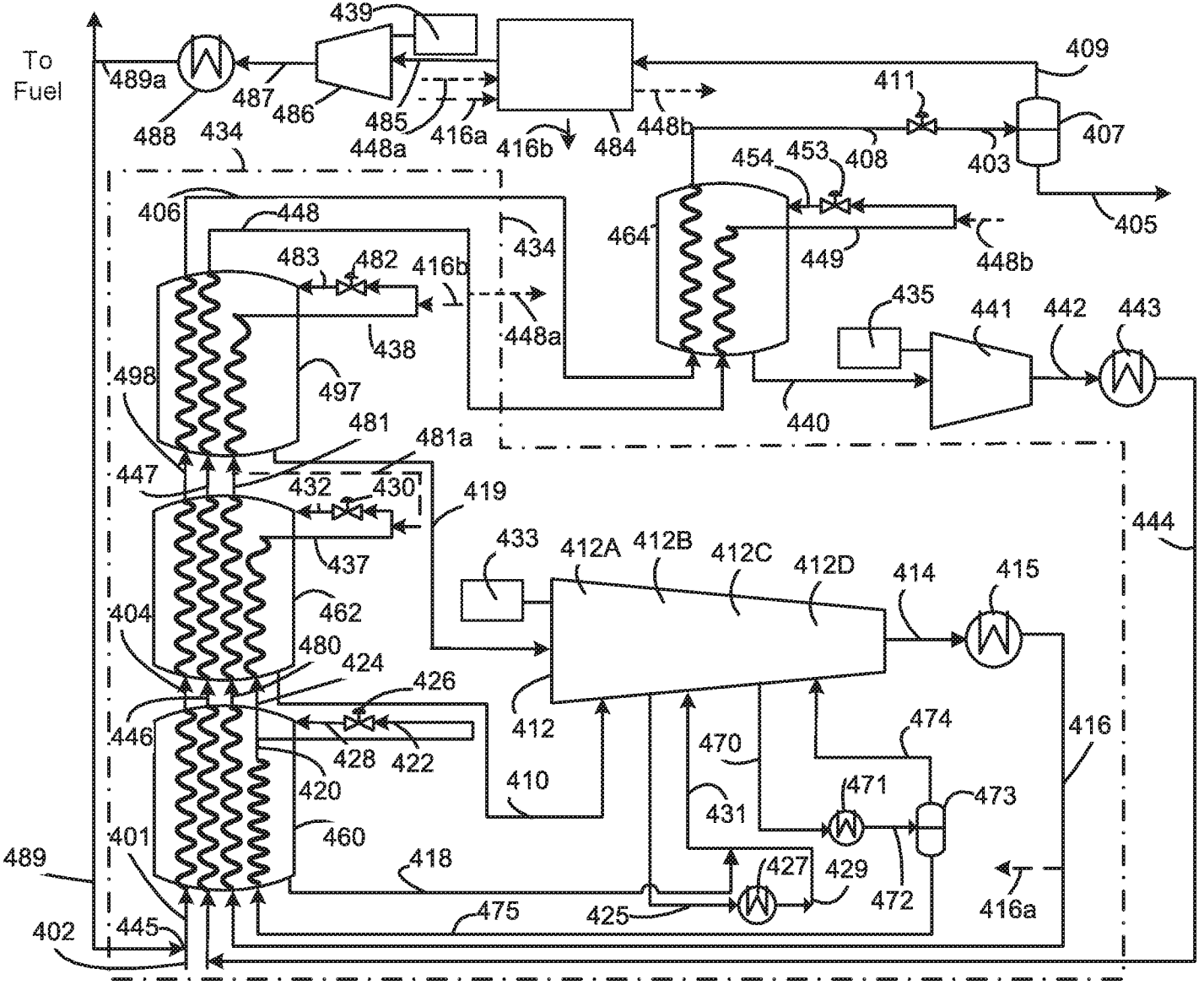
FIG. 4 is a schematic flow diagram of a precooling system of a DMR system in accordance with a third exemplary embodiment.

FIG. 4 shows a third embodiment in which three pressure precooling circuits are provided. A low pressure WMR stream 419 is withdrawn from the warm end of shell side of a third precooling heat exchanger 497 and compressed in a first compression stage 412A of a WMR compressor 412. A medium pressure WMR stream 410 is withdrawn from the warm end of shell side of a second precooling heat exchanger 462 and introduced as a side-stream into the WMR compressor 412, where it mixes with the compressed stream (not shown) from the first compression stage 412A. The mixed stream (not shown) is compressed in a second compression stage 412B of the WMR compressor 412 to produce a first intermediate WMR stream 425.

The first intermediate WMR stream 425 is withdrawn from the WMR compressor 412, and cooled in a high pressure WMR intercooler 427, which may be an ambient cooler, to produce a cooled first intermediate WMR stream 429. A high pressure WMR stream 418 is withdrawn from the warm end of the shell side of a first precooling heat exchanger 460 and mixed with the cooled first intermediate WMR stream 429 to produce a mixed high pressure WMR stream 431. Any liquid present in the low pressure WMR stream 419, the medium pressure WMR stream 410, the high pressure WMR stream 418, and the cooled first intermediate WMR stream 429 may be removed in vapor-liquid separation devices (not shown). In an alternate embodiment, the high pressure WMR stream 418 may be introduced at any other suitable location in the WMR compression sequence, for instance as a side stream to the WMR compressor 412 or mixed with any other inlet stream to the WMR compressor 412.

The mixed high pressure WMR stream 431 is introduced into the WMR compressor 412 and compressed in a third WMR compression stage 412C of the WMR compressor 412 to produce a high-high pressure WMR stream 470. The high-high pressure WMR stream 470 may be at a pressure between 5 bara and 35 bara, and preferably between 15 bara and 25 bara. The high-high pressure WMR stream 470 is withdrawn from the WMR compressor 412, cooled and partially condensed in a high-high pressure WMR intercooler 471 to produce a cooled high-high pressure WMR stream 472. The high-high pressure WMR intercooler 471 may be an ambient cooler that uses air or water. The cooled high-high pressure WMR stream 472 may have a vapor fraction between 0.2 and 0.8, preferably between 0.3 and 0.7, and more preferably between 0.4 and 0.6. The cooled high-high pressure WMR stream 472 may comprise less than 20% of components lighter than ethane, preferably less than 10% of components lighter than ethane, and more preferably less than 5% of components lighter than ethane, and is referred to as the "precooling refrigerant composition". The cooled high-high pressure WMR stream 472 is phase separated in a first WMR vapor-liquid separation device 473 to produce a first WMRV stream 474 and a first WMRL stream 475.

The first WMRL stream 475 contains less than 75% of ethane and lighter hydrocarbons, preferably less than 70% of ethane and lighter hydrocarbons, and more preferably less than 60% of ethane and lighter hydrocarbons. The first WMRV stream 474 contains more than 40% of ethane and lighter hydrocarbons, preferably more than 50% of ethane and lighter hydrocarbons, and more preferably more than 60% of ethane and lighter hydrocarbons. The first WMRL stream 475 is introduced into the first precooling heat exchanger 460 to be cooled to produce a second cooled compressed WMR stream 420 that is split into two portions; a first portion 422 and a second portion 424. The first portion 422 of the second cooled compressed WMR stream 420 is expanded in a first WMR expansion device 426 to produce a first expanded WMR stream 428 that provides refrigeration duty to the first precooling heat exchanger 460. The second portion 424 of the second cooled compressed WMR stream 420 is further cooled in a tube circuit of the second precooling heat exchanger 462 to produce a second further cooled WMR stream 437. The second further cooled WMR stream 437 is expanded in a second WMR expansion device 430 to produce a second expanded WMR stream 432, which is introduced into the shell side of the second precooling heat exchanger 462 to provide refrigeration duty.

The first WMRV stream 474 is introduced into the WMR compressor 412 to be compressed in a fourth WMR compression stage 412D to produce a compressed WMR stream 414. The compressed WMR stream 414 is cooled and preferably condensed in a WMR aftercooler 415 to produce a first cooled compressed WMR stream 416. The molar composition of the first cooled compressed WMR stream 416 is the same as that of the first WMRV stream 474. A portion of the first cooled compressed WMR stream 416 may be removed from the precooling system 434 as a portion of the WMR stream 416*a*, cooled in a flash gas exchanger 484 to produce a cooled portion of the WMR stream 416*b*, which may be returned to the precooling system 434 prior to expansion in the third WMR expansion device 482 or the second WMR expansion device 430 or the first WMR expansion device 426 or any other suitable location. The remainder of the first cooled compressed WMR stream 416 may be introduced into the first precooling heat exchanger 460 to be further cooled in a tube circuit to produce a second precooled WMR stream 480. The second precooled WMR stream 480 is introduced into the second precooling heat exchanger 462 to be further cooled to produce a third precooled WMR stream 481, which is introduced into the third precooling heat exchanger 497 to be further cooled to produce a third further cooled WMR stream 438. The third further cooled WMR stream 438 is expanded in a third WMR expansion device 482 to produce a third expanded WMR stream 483, which is introduced into the shell side of the third precooling heat exchanger 497 to provide refrigeration duty.

Optionally, a portion of the third precooled WMR stream 481 may be mixed with the second further cooled WMR stream 437 prior to expansion in the second WMR expansion device 430 (shown with dashed line 481*a*) to provide supplemental refrigeration to the second precooling heat exchanger 462.

The pretreated feed stream 402 (also called a hydrocarbon feed stream) is mixed with a recycle stream 489 at mixing point 445 to produce a mixed feed stream 401, which is cooled in the first precooling heat exchanger 460 to produce a first precooled natural gas stream 404. The first precooled natural gas stream 404 is cooled in the second precooling heat exchanger 462 to produce a third precooled natural gas stream 498, which is further cooled in the third precooling heat exchanger 497 to produce a second precooled natural gas stream 406. A compressed cooled CMR stream 444 is cooled in the first precooling heat exchanger 460 to produce a first precooled CMR stream 446. The compressed cooled CMR stream 444 may comprise more than 20% of components lighter than ethane, preferably more than 30% of components lighter than ethane, and, more preferably, more than 40% of components lighter than ethane and is referred to as the "liquefaction refrigerant composition". The first precooled CMR stream 446 is cooled in a second precooling heat exchanger 462 to produce a third precooled CMR stream 447, which is further cooled in a third precooling heat exchanger 497 to produce a second precooled CMR stream 448.

The second precooled natural gas stream 406 and the second precooled CMR stream 248 are sent to the liquefaction system 465. The second precooled natural gas stream is liquefied and optionally subcooled in the MCHE 464 to produce the first LNG stream 408 (referred to as a liquefied hydrocarbon stream in the claims) at a temperature between about −160 degrees Celsius and about −70 degrees Celsius, preferably between about −150 degrees Celsius and about −100 degrees Celsius. The second precooled CMR stream 448 is preferably fully condensed and subcooled in the MCHE 464, resulting in a cold stream that is let down in pressure across CMRL expansion device 453 to produce an expanded CMRL stream 454, that is sent back to the shell side of MCHE 464 to provide refrigeration required. The MCHE 464 is shown as a single bundle exchanger, however multiple bundles or exchangers may be used. Further, the second precooled CMR stream 448 may be two-phase and it may be beneficial to separate it into vapor and liquid phases and utilize separate cooling circuits in the MCHE as well as separate expansion devices, as shown in FIG. 1.

A warm low pressure CMR stream 440 is withdrawn from the warm end of the shell side of the MCHE 464, sent through a suction drum (not shown) to separate out any liquids and the vapor stream is compressed in CMR compressor 441 to produce a compressed CMR stream 442. The warm low pressure CMR stream 440 is typically withdrawn at a temperature at or near WMR precooling temperature and preferably less than about −30 degree Celsius and at a pressure of less than 10 bara (145 psia). The compressed CMR stream 442 is cooled in a CMR aftercooler 443, typically against ambient air, to produce a compressed cooled CMR stream 444. Additional phase separators, compressors, and aftercoolers may be present. The compressed cooled CMR stream 444 is then introduced into the first precooling heat exchanger 460.

The first LNG stream 408 may be let down in pressure by passing it through the LNG pressure letdown device 411 to produce the reduced pressure LNG stream 403, which is then sent to the flash drum 407 to produce a flash gas stream 409 and a second LNG stream 405. The second LNG stream 405 may be let down to storage pressure and sent to an LNG storage tank (not shown). The flash gas stream 409 may also include any boil-off gas (BOG) produced in the storage tank. The flash gas stream 409 may be warmed in a flash gas exchanger 484 to produce a warmed flash gas stream 485. The warmed flash gas stream 485 may be compressed in a flash gas compressor 486 to produce a compressed flash gas stream 487, which is cooled in a flash gas cooler 488 to produce the recycle stream 489, and optionally a fuel gas stream 489*a* to be used as fuel in the facility. The recycle stream 489 is mixed with the pretreated feed stream 402.

A portion of CMR stream 448*a* may be removed from the liquefaction system 465 at any location, such as from the second precooled CMR stream 448. The portion of CMR stream 448*a* may be cooled against the flash gas stream 409 to produce a cooled portion of CMR stream 448*b*, which may be returned to the liquefaction system 465 at a suitable location, such as upstream of the CMRL expansion device 453. The portion of the WMR stream 416*a* may also be cooled against the flash gas stream 409 to produce the cooled portion of the WMR stream 416*b*.

Although FIG. 4 shows four compression stages, any number of compression stages may be present. Further, the compression stages may be part of a single compressor body, or be multiple separate compressors with optional intercooling. The WMR compressor 412, CMR compressor 441, and/or the flash gas compressor 486 may be any type of compressor such as centrifugal, axial, positive displacement, or any other compressor type and may comprise any number of stages with optional inter-cooling.

As in FIG. 2, in a preferred embodiment, the second precooled CMR stream 448 may be fully condensed, eliminating the need for the CMR phase separator 150 in FIG. 1 as well as the CMRV expansion device 155 in FIG. 1. In this embodiment, the main cryogenic heat exchanger 164 in FIG. 1 may be a single bundle heat exchanger with two warm feed streams: the second precooled natural gas stream 406 and the second precooled CMR stream 448.

In the embodiment shown in FIG. 4, the warmest heat exchange section is the first precooling heat exchanger 460 and the coldest heat exchange section is the third precooling heat exchanger 497.

The embodiment shown in FIG. 4 possesses all of the benefits of the embodiment shown in FIG. 2. A further embodiment is a variation of FIG. 4 with only two precooling heat exchangers, such that the entire second cooled compressed WMR stream 420 is used to provide refrigeration to the first heat exchanger. This embodiment eliminates the need for an additional heat exchanger and is lower in capital cost.

Figure 5:
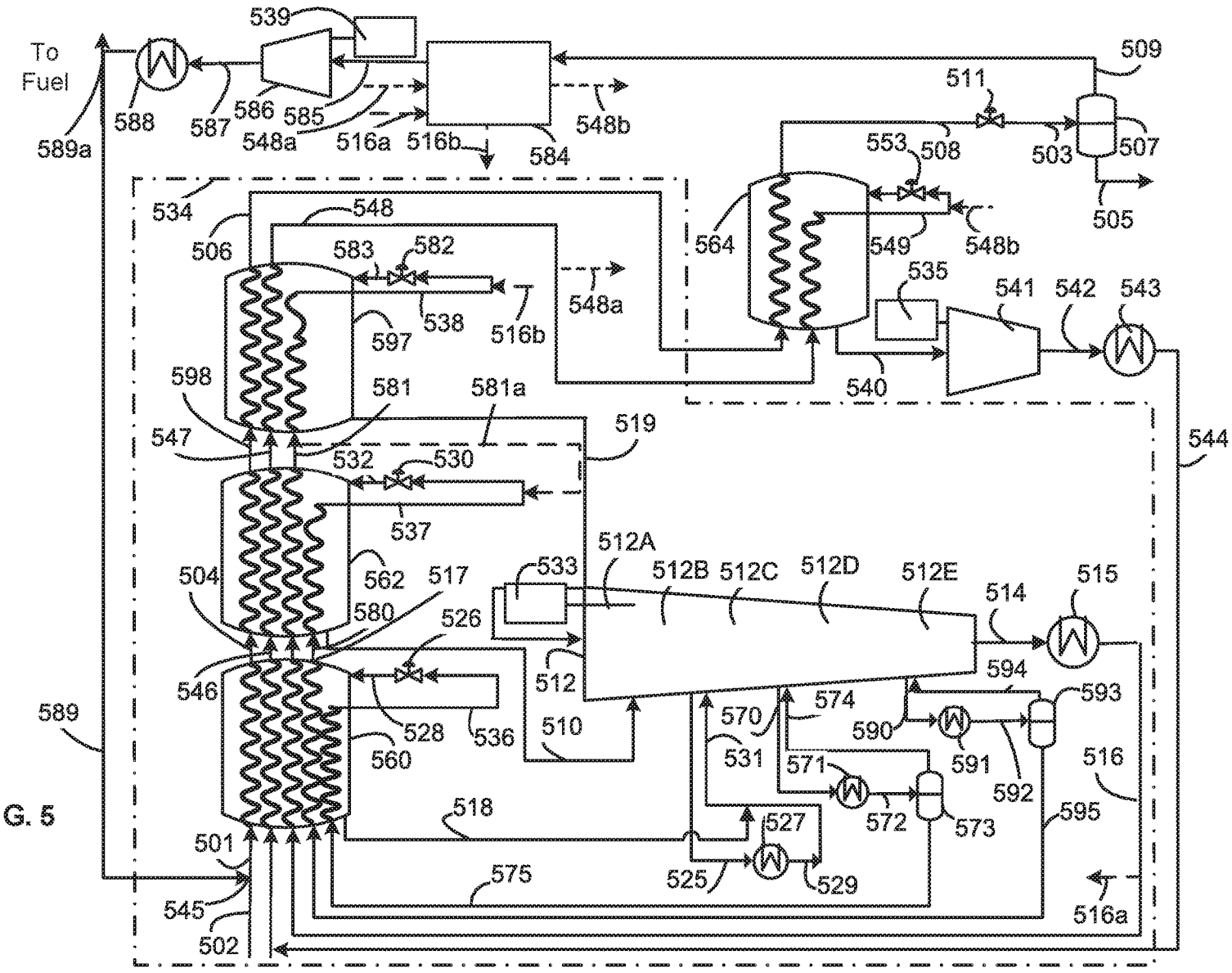
FIG. 5 is a schematic flow diagram of a precooling system of a DMR system in accordance with a fourth exemplary embodiment.

FIG. 5 shows a fourth embodiment and a variation of the embodiment shown in FIG. 4 with three precooling heat exchangers. A low pressure WMR stream 519 is withdrawn from the warm end of the shell side of a third precooling heat exchanger 597 and compressed in a first compression stage 512A of a WMR compressor 512. A medium pressure WMR stream 510 is withdrawn from the warm end of shell side of a second precooling heat exchanger 562 and introduced as a side-stream into the WMR compressor 512, where it mixes with the compressed stream (not shown) from the first compression stage 512A. The mixed stream (not shown) is compressed in a second compression stage 512B of the WMR compressor 512 to produce a first intermediate WMR stream 525. The first intermediate WMR stream 525 is cooled in a high pressure WMR intercooler 527, which may be an ambient cooler, to produce a cooled first intermediate WMR stream 529.

Any liquid present in the low pressure WMR stream 519, the medium pressure WMR stream 510, and the high pressure WMR stream 518 may be removed in vapor-liquid separation devices (not shown).

A high pressure WMR stream 518 is withdrawn from the warm end of the shell side of a first precooling heat exchanger 560 and mixed with the cooled first intermediate WMR stream 529 to produce a mixed high pressure WMR stream 531.

The mixed high pressure WMR stream 531 is introduced into the WMR compressor 512 to be compressed in a third WMR compression stage 512C of the WMR compressor 512 to produce a high-high pressure WMR stream 570. The high-high pressure WMR stream 570 may be at a pressure between 5 bara and 35 bara, and preferably between 10 bara and 25 bara. The high-high pressure WMR stream 570 is withdrawn from the WMR compressor 512, and cooled and partially condensed in a high-high pressure WMR intercooler 571 to produce a cooled high-high pressure WMR stream 572. The high-high pressure WMR intercooler 571 may be an ambient cooler that uses air or water. The cooled high-high pressure WMR stream 572 may have a vapor fraction between 0.2 and 0.8, preferably between 0.3 and 0.7, and more preferably between 0.4 and 0.6. The cooled high-high pressure WMR stream 572 may comprise less than 20% of components lighter than ethane, preferably less than 10% of components lighter than ethane, and more preferably less than 5% of components lighter than ethane, and is referred to as the "precooling refrigerant composition". The cooled high-high pressure WMR stream 572 is phase separated in a first WMR vapor-liquid separation device 573 to produce a first WMRV stream 574 and a first WMRL stream 575.

The first WMRL stream 575 contains less than 75% of ethane and lighter hydrocarbons, preferably less than 70% of ethane and lighter hydrocarbons, and more preferably less than 60% of ethane and lighter hydrocarbons. The first WMRV stream 574 contains more than 40% of ethane and lighter hydrocarbons, preferably more than 50% of ethane and lighter hydrocarbons, and more preferably more than 60% of ethane and lighter hydrocarbons. The first WMRL stream 575 is introduced into the first precooling heat exchanger 560 to be cooled in a tube circuit to produce a first further cooled WMR stream 536. The first further cooled WMR stream 536 is expanded in a first WMR expansion device 526 to produce a first expanded WMR stream 528. The first expanded WMR stream 528 provides refrigeration duty for the first precooling heat exchanger 560.

The first WMRV stream 574 is introduced into the WMR compressor 512 to be compressed in a fourth WMR compression stage 512D to produce a second intermediate WMR stream 590 at a pressure between 10 bara and 50 bara, and preferably between 15 bara and 45 bara. The second intermediate WMR stream 590 is withdrawn from the WMR compressor 512, and cooled and partially condensed in a first WMRV intercooler 591 to produce a cooled second intermediate WMR stream 592. The first WMRV intercooler 591 may be an ambient cooler that cools against air or water. The cooled second intermediate WMR stream 592 may have a vapor fraction between 0.2 and 0.8, preferably between 0.3 and 0.7, and more preferably between 0.4 and 0.6. The cooled second intermediate WMR stream 592 is phase separated in a second WMR vapor-liquid separation device 593 to produce a second WMRV stream 594 and a second WMRL stream 595. The second WMRL stream 595 contains between about 40% and 80% of ethane and lighter hydrocarbons, preferably between about 50% and 75% of ethane and lighter hydrocarbons, and more preferably between about 60% and 70% of ethane and lighter hydrocarbons.

The second WMRL stream 595 is cooled in a tube circuit of the first precooling heat exchanger 560 to produce a first precooled WMR stream 517. The first precooled WMR stream 517 is further cooled in a tube circuit of the second precooling heat exchanger 562 to produce a second further cooled WMR stream 537. The second further cooled WMR stream 537 is expanded in a second WMR expansion device 530 to produce a second expanded WMR stream 532 that provides refrigeration duty to the second precooling heat exchanger 562. In an alternate embodiment, a portion of the first precooled WMR stream 517 may be mixed with the first further cooled WMR stream 536 prior to expansion in the first WMR expansion device 526 in order to provide supplemental refrigeration to the first precooling heat exchanger 560.

The second WMRV stream 594 is introduced into the WMR compressor 512 to be compressed in a fifth WMR compression stage 512E to produce a compressed WMR stream 514. The compressed WMR stream 514 is cooled and preferably condensed in a WMR aftercooler 515 to produce a first cooled compressed WMR stream 516. The first cooled compressed WMR stream 516 contains more than 40% of ethane and lighter hydrocarbons, preferably more than 50% of ethane and lighter hydrocarbons, and more preferably more than 60% of ethane and lighter hydrocarbons. A portion of the first cooled compressed WMR stream 516 may be removed from the precooling system 534 as a portion of the WMR stream 516*a*, cooled in a flash gas exchanger 584 to produce a cooled portion of the WMR stream 516*b*, which may be returned to the precooling system 534 prior to expansion in the third WMR expansion device 582, or the second WMR expansion device 530, or the first WMR expansion device 526, or any other suitable location. The remainder of the first cooled compressed WMR stream 516 may be introduced into the first precooling heat exchanger 560 to be further cooled in a tube circuit to produce a second precooled WMR stream 580. The second precooled WMR stream 580 is introduced into the second precooling heat exchanger 562 to be further cooled to produce a third precooled WMR stream 581, which is introduced into the third precooling heat exchanger 597 to be further cooled to produce a third further cooled WMR stream 538. The third further cooled WMR stream 538 is expanded in a third WMR expansion device 582 to produce a third expanded WMR stream 583, which is introduced into the shell side of the third precooling heat exchanger 597 to provide refrigeration duty.

The pretreated feed stream 502 (referred to the claims as a hydrocarbon feed stream) is mixed with a recycle stream 589 to produce a mixed feed stream 501, which is cooled in the first precooling heat exchanger 560 to produce a first precooled natural gas stream 504. The first precooled natural gas stream 504 is cooled in the second precooling heat exchanger 562 to produce a third precooled natural gas stream 598, which is further cooled in the third precooling heat exchanger 597 to produce a second precooled natural gas stream 506. A compressed cooled CMR stream 544 is cooled in the first precooling heat exchanger 560 to produce a first precooled CMR stream 546. The compressed cooled CMR stream 544 may comprise more than 20% of components lighter than ethane, preferably more than 30% of components lighter than ethane, and, more preferably, more than 40% of components lighter than ethane and is referred to as the "liquefaction refrigerant composition". The first precooled CMR stream 546 is cooled in a second precooling heat exchanger 562 to produce a third precooled CMR stream 547, which is further cooled in a third precooling heat exchanger 597 to produce a second precooled CMR stream 548.

The second precooled natural gas stream 506 and the second precooled CMR stream 548 are sent to the liquefaction system 565. The second precooled natural gas stream is liquefied and optionally subcooled in the MCHE 564 to produce the first LNG stream 508 (referred to as a liquefied hydrocarbon stream in the claims) at a temperature between about −160 degrees Celsius and about −70 degrees Celsius, preferably between about −150 degrees Celsius and about −100 degrees Celsius. The second precooled CMR stream 548 is preferably fully condensed and subcooled in the MCHE 564, resulting in a cold stream that is let down in pressure across CMRL expansion device 553 to produce an expanded CMRL stream 554, that is sent back to the shell side of MCHE 564 to provide the refrigeration required. The MCHE 564 is shown as a single bundle exchanger, however multiple bundles or exchangers may be used. Further, the second precooled CMR stream 548 may be two-phase and it may be beneficial to separate it into vapor and liquid phases and utilize separate cooling circuits in the MCHE as well as separate expansion devices, as shown in FIG. 1.

A warm low pressure CMR stream 540 is withdrawn from the warm end of the shell side of the MCHE 564, sent through a suction drum (not shown) to separate out any liquids and the vapor stream is compressed in CMR compressor 541 to produce a compressed CMR stream 542. The warm low pressure CMR stream 520 is typically withdrawn at a temperature at or near WMR precooling temperature and preferably less than about −30 degree Celsius and at a pressure of less than 10 bara (145 psia). The compressed CMR stream 542 is cooled in a CMR aftercooler 543, typically against ambient, to produce a compressed cooled CMR stream 544. Additional phase separators, compressors, and aftercoolers may be present. The compressed cooled CMR stream 544 is then introduced into the first precooling heat exchanger 560.

The first LNG stream 508 may be let down in pressure by passing it through the LNG pressure letdown device 511 to produce the reduced pressure LNG stream 503, which is then sent to the flash drum 507 to produce a flash gas stream 509 and a second LNG stream 505. The second LNG stream 505 may be letdown to storage pressure and sent to an LNG storage tank (not shown). The flash gas stream 509 may also include any boil-off gas (BOG) produced in the storage tank. The flash gas stream 509 may be warmed in a flash gas exchanger 584 to produce a warmed flash gas stream 585. The warmed flash gas stream 585 may be compressed in a flash gas compressor 586 to produce a compressed flash gas stream 587, which is cooled in a flash gas cooler 588 to produce the recycle stream 589 and optionally a fuel gas stream 589*a* to be used as fuel in the facility. The recycle stream 589 is mixed with the pretreated feed stream 502.

A portion of CMR stream 548*a* may be removed from the liquefaction system 565 at any location, such as from the second precooled CMR stream 548. The portion of CMR stream 548*a* may be cooled against the flash gas stream 509 to produce a cooled portion of CMR stream 548*b*, which may be returned to the liquefaction system 565 at a suitable location, such as upstream of the CMRL expansion device 553. The portion of the WMR stream 516*a* may also be cooled against the flash gas stream 509 to produce the cooled portion of the WMR stream 516*b*.

In the embodiment shown in FIG. 5, the warmest heat exchange section is the first precooling heat exchanger 560 and the coldest heat exchange section is the third precooling heat exchanger 597.

FIG. 5 possesses all the benefits of the embodiment described in FIG. 2. It involves a third precooling heat exchanger and additional compression stages, therefore it has a higher capital cost than FIG. 2. However, FIG. 5 involves three different WMR compositions, one for each of the three precooling heat exchangers. Therefore, the embodiment of FIG. 5 results in improved process efficiency at increased capital cost.

Optionally, a portion of the second precooled WMR stream 580 may be mixed with the first further cooled WMR stream 536 prior to expansion in the first WMR expansion device 526 to provide supplemental refrigeration to the first precooling heat exchanger 560 (shown with dashed line 581*a*). Alternatively or additionally, a portion of the third precooled WMR stream 581 may be mixed with the second further cooled WMR stream 537 prior to expansion in the second WMR expansion device 530 in order to provide supplemental refrigeration duty to the second precooling heat exchanger 562.

Figure 6:
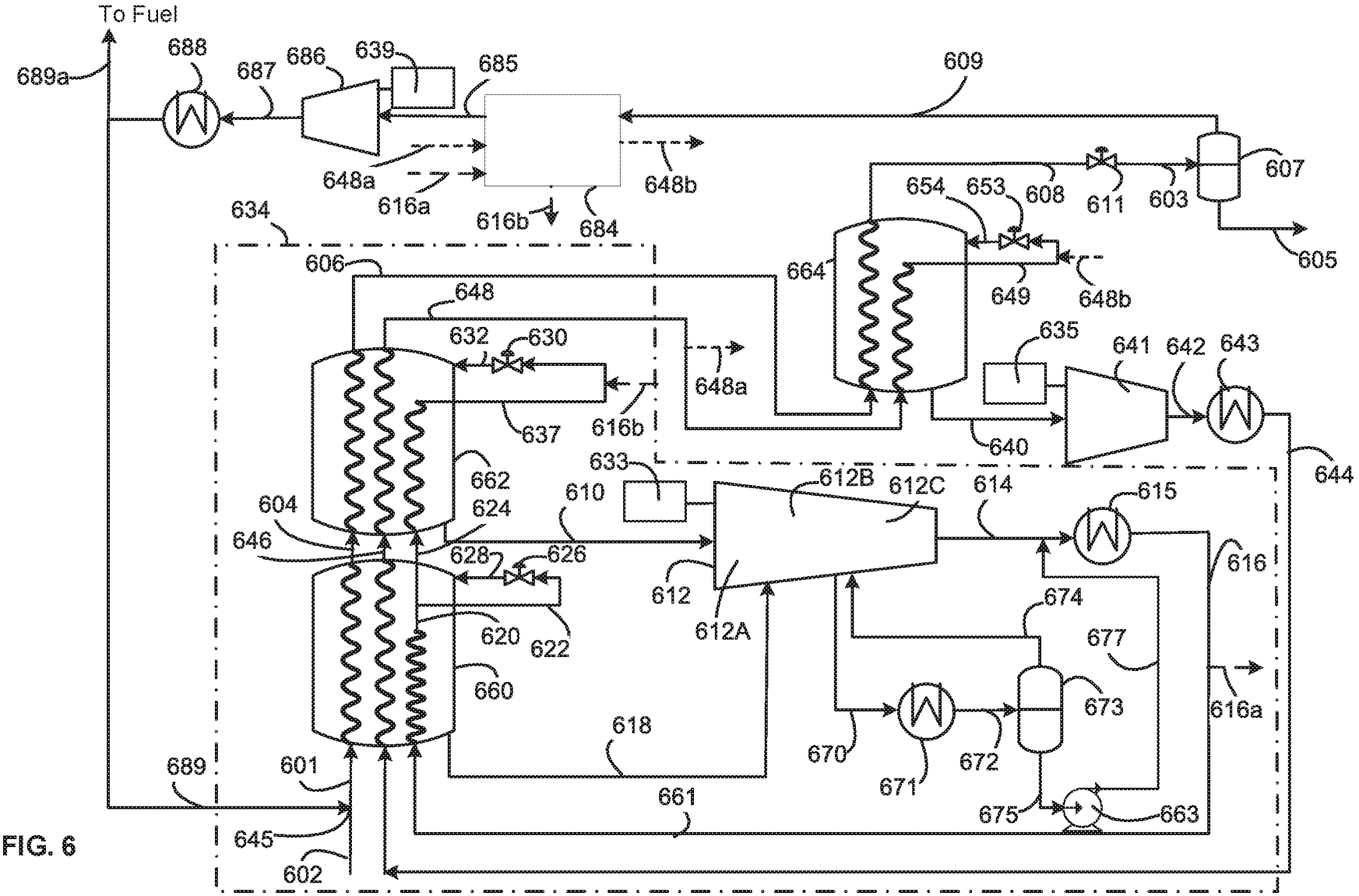
FIG. 6 is a schematic flow diagram of a precooling system of a DMR system in accordance with a fifth exemplary embodiment.

FIG. 6 shows a fifth embodiment, which is a variation of FIG. 2. A low pressure WMR stream 610 is withdrawn from the warm end of the shell side of a second precooling heat exchanger 662 and compressed in a first compression stage 612A of a WMR compressor 612. A medium pressure WMR stream 618 is withdrawn from the warm end of the shell side of a first precooling heat exchanger 660 and introduced as a side-stream into the WMR compressor 612, where it mixes with compressed stream (not shown) from the first compression stage 612A. The mixed stream (not shown) is compressed in a second WMR compression stage 612B of the WMR compressor 612 to produce a high-high pressure WMR stream 670. Any liquid present in the low pressure WMR stream 610 and the medium pressure WMR stream 618 are removed in vapor-liquid separation devices (not shown) prior to introduction in the WMR compressor 612.

The high-high pressure WMR stream 670 may be at a pressure between 5 bara and 40 bara, and preferably between 15 bara and 30 bara. The high-high pressure WMR stream 670 is withdrawn from the WMR compressor 612, and cooled and partially condensed in a high-high pressure WMR intercooler 671 to produce a cooled high-high pressure WMR stream 672. The high-high pressure WMR intercooler 671 may be any suitable type of cooling unit, such as an ambient cooler that uses air or water, and may comprise one or more heat exchangers. The cooled high-high pressure WMR stream 672 may have a vapor fraction between 0.2 and 0.8, preferably between 0.3 and 0.7, and more preferably between 0.4 and 0.6. The cooled high-high pressure WMR stream 672 may comprise less than 20% of components lighter than ethane, preferably less than 10% of components lighter than ethane, and more preferably less than 5% of components lighter than ethane, and is referred to as the "precooling refrigerant composition". The cooled high-high pressure WMR stream 672 is phase separated in a first WMR vapor-liquid separation device 673 to produce a first WMRV stream 674 and a first WMRL stream 675.

The first WMRL stream 675 contains less than 75% of ethane and lighter hydrocarbons, preferably less than 70% of ethane and lighter hydrocarbons, and more preferably less than 60% of ethane and lighter hydrocarbons. The first WMRV stream 674 contains more than 40% of ethane and lighter hydrocarbons, preferably more than 50% of ethane and lighter hydrocarbons, and more preferably more than 60% of ethane and lighter hydrocarbons. The first WMRL stream 675 is increased in pressure in a WMR pump 663 to produce a pumped first WMRL stream 677.

The first WMRV stream 674 is introduced into the WMR compressor 612 to be compressed in a third WMR compression stage 612C of WMR compressor 612 to produce a compressed WMR stream 614, which may be mixed with the pumped first WMRL stream 677 to produce a mixed compressed WMR stream 661. The mixed compressed WMR stream 661 is cooled and preferably condensed in a WMR aftercooler 615 to produce a first cooled compressed WMR stream 616 (also referred to as a compressed first refrigerant stream). The composition of the first cooled compressed WMR stream 616 is the same as that of the cooled high-high pressure WMR stream 672. A portion of the first cooled compressed WMR stream 616 may be removed from the precooling system 634 as a portion of the WMR stream 616*a*, cooled in a flash gas exchanger 684 to produce a cooled portion of the WMR stream 616*b*, which may be returned to the precooling system 634 prior to expansion in the second WMR expansion device 630, or the first WMR expansion device 626, or any other suitable location.

The remainder of the first cooled compressed WMR stream 616 is then introduced into the first precooling heat exchanger 660 to be further cooled in a tube circuit to produce a second cooled compressed WMR stream 620. The second cooled compressed WMR stream 620 is split into two portions; a first portion 622 and a second portion 624. The first portion 622 of the second cooled compressed WMR stream 620 is expanded in a first WMR expansion device 626 to produce a first expanded WMR stream 628, which is introduced into the shell side of the first precooling heat exchanger 660 to provide refrigeration duty. The second portion 624 of the second cooled compressed WMR stream 620 is introduced into the second precooling heat exchanger 662 to be further cooled, thereby forming a second further cooled WMR stream 637, after which it is expanded in a second WMR expansion device 630 to produce a second expanded WMR stream 632, which is introduced into the shell side of the second precooling heat exchanger 662 to provide refrigeration duty.

The first cooled compressed WMR stream 616 may be fully condensed or partially condensed. In a preferred embodiment, the first cooled compressed WMR stream 616 is fully condensed. Due to the precooling refrigerant composition, it is possible to fully condense the compressed WMR stream 614 to produce a totally condensed first cooled compressed WMR stream 616 without needing to compress to very high pressure. The compressed WMR stream 614 may be at a pressure between 300 psia (21 bara) and 600 psia (41 bara), and preferably between 400 psia (28 bara) and 500 psia (35 bara). If the second precooling heat exchanger 662 was a liquefaction heat exchanger used to fully liquefy the natural gas, the cooled high-high pressure WMR stream 672 would have a higher concentration of nitrogen and methane and therefore the pressure of the compressed WMR stream 614 would have to be higher in order for the first cooled compressed WMR stream 616 to be fully condensed. Since this may not be possible to achieve, the first cooled compressed WMR stream 616 would not be fully condensed and would contain significant vapor concentration that may need to be liquefied separately.

A pretreated feed stream 602 (referred to the claims as a hydrocarbon feed stream) is mixed with a recycle stream 689 to produce a mixed feed stream 601, which is cooled in a first precooling heat exchanger 660 to produce a first precooled natural gas stream 604 at a temperature below 20 degrees Celsius, preferably below about 10 degrees Celsius, and more preferably below about 0 degrees Celsius. As is known in the art, the feed stream 602 has preferably been pretreated to remove moisture and other impurities such as acid gases, mercury, and other contaminants. The first precooled natural gas stream 604 is cooled in a second precooling heat exchanger 662 to produce the second precooled natural gas stream 606 at a temperature below 10 degrees Celsius, preferably below about 0 degrees Celsius, and more preferably below about −30 degrees Celsius, depending on ambient temperature, natural gas feed composition and pressure. The second precooled natural gas stream 606 may be partially condensed.

A compressed cooled CMR stream 644 (also referred to as a second refrigerant feed stream) is cooled in the first precooling heat exchanger 660 to produce a first precooled CMR stream 646. The compressed cooled CMR stream 644 may comprise more than 20% of components lighter than ethane, preferably more than 30% of components lighter than ethane, and, more preferably, more than 40% of components lighter than ethane and is referred to as the "liquefaction refrigerant composition". The first precooled CMR stream 646 is cooled in a second precooling heat exchanger 662 to produce a second precooled CMR stream 648 (also referred to as precooled second refrigerant stream).

The second precooled natural gas stream 606 and the second precooled CMR stream 648 are sent to the liquefaction system 665. The second precooled natural gas stream is liquefied and optionally subcooled in the MCHE 664 to produce the first LNG stream 608 (referred to as a liquefied hydrocarbon stream in the claims) at a temperature between about −160 degrees Celsius and about −70 degrees Celsius, preferably between about −150 degrees Celsius and about −100 degrees Celsius. The second precooled CMR stream 648 is preferably fully condensed and subcooled in the MCHE 664, resulting in a cold stream that is let down in pressure across CMRL expansion device 653 to produce an expanded CMRL stream 654, that is sent back to the shell side of MCHE 664 to provide the required refrigeration. The MCHE 664 is shown as a single bundle exchanger, however multiple bundles or exchangers may be used. Further, the second precooled CMR stream 648 may be two-phase and it may be beneficial to separate it into vapor and liquid phases and utilize separate cooling circuits in the MCHE as well as separate expansion devices, as shown in FIG. 1.

A warm low pressure CMR stream 640 is withdrawn from the warm end of the shell side of the MCHE 664, sent through a suction drum (not shown) to separate out any liquids and the vapor stream is compressed in CMR compressor 641 to produce a compressed CMR stream 642. The warm low pressure CMR stream 640 is typically withdrawn at a temperature at or near WMR precooling temperature and preferably less than about −30 degree Celsius and at a pressure of less than 10 bara (145 psia). The compressed CMR stream 642 is cooled in a CMR aftercooler 643, typically against ambient, to produce a compressed cooled CMR stream 644. Additional phase separators, compressors, and aftercoolers may be present. The compressed cooled CMR stream 644 is then introduced into the first precooling heat exchanger 660.

The first LNG stream 608 may be let down in pressure by passing it through the LNG pressure letdown device 611 to produce the reduced pressure LNG stream 603, which is then sent to the flash drum 607 to produce a flash gas stream 609 and a second LNG stream 605. The second LNG stream 605 may be letdown to storage pressure and sent to an LNG storage tank (not shown). The flash gas stream 609 may also include any boil-off gas (BOG) produced in the storage tank. The flash gas stream 609 may be warmed in a flash gas exchanger 684 to produce a warmed flash gas stream 685. The warmed flash gas stream 685 may be compressed in a flash gas compressor 686 to produce a compressed flash gas stream 687, which is cooled in a flash gas cooler 688 to produce the recycle stream 689, and optionally a fuel gas stream 689*a* to be used as fuel in the facility. The recycle stream 689 is mixed with the pretreated feed stream 602.

A portion of CMR stream 648*a* may be removed from the liquefaction system 665 at any location, such as from the second precooled CMR stream 648. The portion of CMR stream 648*a* may be cooled against the flash gas stream 609 to produce a cooled portion of CMR stream 648*b*, which may be returned to the liquefaction system 665 at a suitable location, such as upstream of the CMRL expansion device 653. The portion of the WMR stream 616*a* may also be cooled against the flash gas stream 609 to produce the cooled portion of the WMR stream 616*b*.

Although FIG. 6 shows two precooling heat exchangers and two pressure levels in the precooling circuit, any number of precooling heat exchangers and pressure levels may be utilized. The precooling heat exchangers are shown to be coil wound heat exchangers in FIG. 6. However, they may be plate and fin heat exchangers, shell and tube heat exchangers, or any other heat exchangers suitable for precooling natural gas. Further, the heat exchangers may be manufactured by any method, including additive printing manufacturing methods.

The two precooling heat exchangers (660, 662) of FIG. 6 may be two heat exchange sections within a single heat exchanger. Alternatively, the two precooling heat exchangers may be two heat exchangers, each with one or more heat exchange sections.

The WMR compressor 612, CMR compressor 641, and/or the flash gas compressor 686 may be any type of compressor such as centrifugal, axial, positive displacement, or any other compressor type and may comprise any number of stages with optional inter-cooling.

In the embodiment shown in FIG. 6, the warmest heat exchange section is the first precooling heat exchanger 660 and the coldest heat exchange section is the second precooling heat exchanger 662.

In a preferred embodiment, the second precooled CMR stream 648 may be fully condensed, eliminating the need for the CMR phase separator 150 in FIG. 1 as well as the CMRV expansion device 155 in FIG. 1. In this embodiment, the main cryogenic heat exchanger 164 in FIG. 1 may be a single bundle heat exchanger with two warm feed streams: the second precooled natural gas stream 606 and the second precooled CMR stream 648.

The advantage of FIG. 6 over the prior art is that it improves the efficiency of the precooling process by addition of the WMR pump 663. By only compressing the vapor from the first WMR vapor-liquid separation device and knocking out the interstage liquid and pumping it separately, the efficiency of the precooling process increases significantly.

Additionally, the embodiment shown in FIG. 6 allows the temperature for the first LNG stream 608 to be warmer than the prior art, while still providing the same temperature of the second LNG stream 605 in tank. This is because a larger amount of flash gas is produced than for the prior art cases. Therefore, the liquefaction and subcooling duty is reduced, lowering the overall power requirement for the facility. The embodiment also allows an equal power split between the precooling and liquefaction system.

In all the embodiments (FIG. 2-FIG. 6 and variations thereof), any liquid present in warm shell side streams from the precooling heat exchangers may be sent to vapor-liquid phase separators to remove any liquid prior to compressing the vapor in the WMR compressor. In alternate embodiments, if significant amounts of liquid are present in the warm shell side streams from the precooling heat exchangers, the liquid fraction may be pumped to be mixed with the discharge of any compression stage or mixed with one or more liquid streams to be introduced into a precooling heat exchanger, or introduced in a separate circuit in a precooling heat exchanger. For instance, in FIG. 5, any liquid present in the high pressure WMR stream 518, the low pressure WMR stream 519, or the medium pressure WMR stream 510 may be pumped to be mixed with the compressed WMR stream 514, or the first WMRL stream 575.

In all the embodiments, any aftercooler or intercooler can comprise multiple individual heat exchangers such as a desuperheater and a condenser.

In FIG. 2-6, a portion of the pretreated feed stream 202 in FIG. 2 may also be cooled and optionally liquefied in the flash gas exchanger 284 to produce supplemental LNG that may be let down in storage pressure and sent to the storage tank (not shown).

The temperature of the second precooled natural gas stream (206, 306, 406, 506) may be defined as the "precooling temperature". The precooling temperature is the temperature at which the feed natural gas stream exits the precooling system and enters the liquefaction system. The precooling temperature has an impact on the power requirement for precooling and liquefying the feed natural gas.

As used herein the term "precooling power requirement" means the power required to operate the compressor 212 used to compress the precooling refrigerant under a particular set of operating conditions (feed stream flow rate, precooling, and liquefaction cold end temperatures, etc.). Similarly, the term "liquefaction power requirement" means the power required to operate the compressor 241 used to compress the liquefaction refrigerant under a particular set of operating conditions. The ratio of the precooling power requirement to the liquefaction power requirement is defined as the "power split" for the system. For the embodiments described in FIGS. 2-6, the power split is between 0.2 and 0.7, preferably between 0.3 and 0.6, and more preferably between 0.45 and 0.55.

The compressor 212 is driven by a driver 233, and compressor 241 is driven by a driver 235, each of which is schematically shown in FIG. 2. As is known in the art, each compressor in the system 200 requires a driver to operate. In the interest of simplifying the drawings, drivers are only shown on compressors which are part of the precooling and liquefaction subsystems. Any suitable driver know in the art could be used, such as an electric motor, aero-derivative gas turbine, or industrial gas turbine, for example.

As the power split increases, the power requirement for liquefaction system decreases and the precooling temperature decreases. In other words, the refrigeration load is shifted from the liquefaction system into the precooling system. This is beneficial for systems where the MCHE size and/or liquefaction power availability are controlling. As the power split reduces, the power requirement for liquefaction system increases and the precooling temperature increases. In other words, the refrigeration load is shifted from the precooling system into the liquefaction system. This arrangement is beneficial for systems wherein the precooling exchanger size, number, or precooling power availability is limiting. The power split is typically determined by the type, quantity, and capacity of the drivers selected for a particular natural gas liquefaction facility. For instance, if an even number of drivers is available, it may be preferable to operate at a power split of about 0.5, shifting the power load into the precooling heat exchanger, and lowering the precooling temperature. If an odd number of drivers is available, the power split may be between 0.3 and 0.5, shifting refrigeration load into the liquefaction system, and raising the precooling temperature.

A key benefit of all the embodiments is that it allows for optimization of the power split, number of the precooling heat exchangers, compression stages, pressure levels, and the precooling temperature based on various factors such as the number, quantity, type, and capacity of drivers available, number of heat exchangers, heat exchanger design criteria, compressor limitations, and other project-specific requirements.

For all the embodiments described, any number of pressure levels may be present in the precooling and liquefaction systems. Further, the refrigeration systems may be open or closed loop.

EXAMPLE

The following is an example of the operation of an exemplary embodiment. The example process and data are based on simulations of a DMR process with a two pressure precooling circuit and a single pressure liquefaction circuit in an LNG plant that produces about 7.5 million metric tons per annum of LNG and specifically refers to the embodiment shown in FIG. 2. In order to simplify the description of this example, elements and reference numerals described with respect to the embodiment shown in FIG. 2 will be used.

A pretreated natural gas feed stream 202 at 91 bara (1320 psia), 24 degrees Celsius (75 degrees Fahrenheit), and a flowrate of 56,000 kgmoles/hr is mixed with a recycle stream 289 at 91 bara (1320 psia), 22 degrees Celsius (72 degrees Fahrenheit), and a flowrate of 5760 kgmoles/hr to produce a mixed feed gas stream, which is cooled in the first precooling heat exchanger 260 to produce a first precooled natural gas stream 204 at −22 degrees Celsius (−8 degrees Fahrenheit), which is cooled in the second precooling heat exchanger 262 to produce the second precooled natural gas stream 206 at −62 degrees Celsius (−80 degrees Fahrenheit).

A warm low pressure CMR stream (mixed feed stream) 201 at 3 bara (44 psia), −65 degrees Celsius (−85 degrees Fahrenheit) is compressed and cooled in multiple stages to produce a compressed cooled CMR stream 244 at 61 bara (891 psia) and 25 degrees Celsius (77 degrees Fahrenheit), which is cooled in the first precooling heat exchanger 260 to produce the first precooled CMR stream 246 at −22 degrees Celsius (−8 degrees Fahrenheit). The compressed cooled CMR stream 244 comprises 55% of components lighter than ethane and 95% of ethane and lighter components. It is then cooled and fully condensed in the second precooling heat exchanger 262 to produce a second precooled CMR stream 248 at −62 degrees Celsius (−80 degrees Fahrenheit). 9 mole % of the second precooled CMR stream 248 is removed as a portion of CMR stream 248*a* to be cooled in the flash gas exchanger 284 to produce a cooled portion of CMR stream 248*b* at −156 degrees Celsius (−249 degrees Fahrenheit) and is let down in pressure in the CML expansion device and introduced into the shell-side of MCHE 264.

The second precooled natural gas stream 206 is liquefied and optionally subcooled in the MCHE 264 to produce the first LNG stream 208 (referred to as a liquefied hydrocarbon stream in the claims) at a temperature of −140 degrees Celsius (−220 degrees Fahrenheit). The first LNG stream 208 is let down in pressure by passing it through the LNG pressure letdown device 211 to produce the reduced pressure LNG stream 203 at −159 degrees Celsius (−254 degrees Fahrenheit) and 1.2 bara (18 psia), which is then sent to the flash drum 207 to produce a flash gas stream 209 at 7,000 kgmoles/hr and a second LNG stream 205. The flash gas stream 209 is 11 mole % of the reduced pressure LNG stream 203. The second LNG stream 205 is letdown to storage pressure and sent to an LNG storage tank.

The flash gas stream 209 is warmed in a flash gas exchanger 284 to produce a warmed flash gas stream 285 at −3 degrees Celsius (−27 degrees Fahrenheit). The warmed flash gas stream 285 is then compressed in a flash gas compressor 286 to produce a compressed flash gas stream 287 at 52 degrees Celsius (126 degrees Fahrenheit) and 92 bara (1327 psia), which is cooled in a flash gas cooler 288 to produce the recycle stream 289, and a fuel gas stream 289*a* to be used as fuel in the facility. The fuel gas stream 289*a* is 16 mole % of the flash gas stream 209.

A low pressure WMR stream 210 (also referred to as a vaporized first refrigerant stream) at 3.8 bara (56 psia), −25 degrees Celsius (−13 degrees Fahrenheit), and 33,000 kgmole/hr is withdrawn from the warm end of shell side of a second precooling heat exchanger 262 and compressed in a first compression stage 212A of a WMR compressor 212. The medium pressure WMR stream 218 (also referred to as a medium pressure first refrigerant stream) at 7 bara (108 psia), 17 degrees Celsius (62 degrees Fahrenheit), and 42,125 kgmole/hr is withdrawn from the warm end of shell side of a first precooling heat exchanger 260 and introduced as a side-stream into the WMR compressor 212, where it mixes with the compressed stream (not shown) from the first compression stage 212A. The mixed stream (not shown) is compressed in a second WMR compression stage 212B of the WMR compressor 212 to produce the high-high pressure WMR stream 270 (also referred to as a high-high pressure first refrigerant stream) at 26 bara (372 psia) and 79 degrees Celsius (175 degrees Fahrenheit).

The high-high pressure WMR stream 270 is withdrawn from the WMR compressor 212, and cooled and partially condensed in the high-high pressure WMR intercooler 271 to produce a cooled high-high pressure WMR stream 272 at 25 bara (363 psia), 25 degrees Celsius (77 degrees Fahrenheit), and vapor fraction of 0.44. The cooled high-high pressure WMR stream 272 is phase separated in a first WMR vapor-liquid separation device 273 to produce a first WMRV stream 274 and a first WMRL stream 275. The first WMRL stream 275 contains 56% of ethane and lighter hydrocarbons while the first WMRV stream 274 contains 80% of ethane and lighter hydrocarbons. The first WMRL stream 275 is introduced into the first precooling heat exchanger 260 to be cooled in a tube circuit to produce a first further cooled WMR stream 236 at −22 degrees Celsius (−8 degrees Fahrenheit) that is expanded in a first WMR expansion device 226 to produce a first expanded WMR stream 228 at 8 bara (115 psia) and −25 degrees Celsius (−13 degrees Fahrenheit) that provides refrigeration duty to the first precooling heat exchanger 260.

The first WMRV stream 274 is introduced into the WMR compressor 212 to be compressed in a third WMR compression stage 212C to produce a compressed WMR stream 214 at 41 bara (598 psia) and 48 degrees Celsius (119 degrees Fahrenheit). The compressed WMR stream 214 is cooled and preferably condensed in a WMR aftercooler 215 to produce a first cooled compressed WMR stream 216 at 25 degrees Celsius (77 degrees Fahrenheit), which is introduced into the first precooling heat exchanger 260 to be further cooled in a tube circuit to produce a first precooled WMR stream 217 at −22 degrees Celsius (−8 degrees Fahrenheit). 5 mole % of the first cooled compressed WMR stream 216 is removed from the precooling system as a portion of WMR stream 216*a* and is cooled in the flash gas exchanger 284 to produce a cooled portion of WMR stream 216*b* at −63 degrees Celsius (−81 degrees Fahrenheit). The first WMRL stream 275 is 16 bara lower in pressure than the first cooled compressed WMR stream 216.

The first precooled WMR stream 217 is introduced into the second precooling heat exchanger 262 to be further cooled in a tube circuit to produce a second further cooled WMR stream 237 at −62 degrees Celsius (−80 degrees Fahrenheit). The second further cooled WMR stream 237 is expanded in a second WMR expansion device 230 to produce a second expanded WMR stream 232 at 3 bara (47 psia) and −57 degrees Celsius (−70 degrees Fahrenheit), which is introduced into the shell side of the second precooling heat exchanger 262 to provide refrigeration duty.

In this example, the power split is 0.52. This embodiment has a process efficiency of about 7% higher than that corresponding to FIG. 1 and a precooling temperature about 18 degrees Celsius colder than that for FIG. 1. Therefore, this example demonstrates that the embodiments described herein provide an efficient method and system to improve the efficiency and overall capacity of the facility.

The invention claimed is:

1. A method comprising:

(a) cooling a hydrocarbon feed stream, a second refrigerant feed stream, and at least one first refrigerant stream, by indirect heat exchange against a shell side first mixed refrigerant stream in each of a plurality of heat exchange sections of a precooling system to produce a precooled hydrocarbon stream, a precooled second refrigerant stream that is at least partially condensed, and a plurality of vaporized first refrigerant streams, the precooling system comprising the plurality of heat exchange sections, at least one compression stage, and at least one aftercooler, wherein the hydrocarbon feed stream comprises a hydrocarbon fluid, the second refrigerant feed stream comprises a second mixed refrigerant, the at least one first refrigerant stream comprises a first mixed refrigerant, and the shell side first mixed refrigerant stream comprises the first mixed refrigerant;

(b) supplying a first inlet stream to a first precooling heat exchange section at a first inlet pressure and a second inlet stream to the first precooling heat exchange section at a second inlet pressure that is higher than the first inlet pressure, each of the first and second inlet streams comprising the first mixed refrigerant, the first mixed refrigerant having a first inlet composition in the first inlet stream and a second inlet composition in the second inlet stream, the first inlet composition being different from the second inlet composition;

(c) withdrawing a first vaporized first refrigerant stream from the first precooling heat exchange section at a first outlet pressure and a first outlet composition and a second vaporized first refrigerant stream from a second precooling heat exchange section at a second outlet pressure that is lower than the first outlet pressure and a second outlet composition, each of the first and second vaporized first refrigerant streams comprising one of the plurality of vaporized first refrigerant streams;

(d) at least partially liquefying the precooled hydrocarbon stream in a main heat exchanger by indirect heat exchange against the second mixed refrigerant to produce a first liquefied hydrocarbon stream at a first liquefied hydrocarbon temperature, the second refrigerant having a second refrigerant composition that is different from the first inlet composition, the second inlet composition, the first outlet composition, and the second outlet composition;

(e) expanding the first liquefied hydrocarbon stream to form a reduced pressure first liquefied hydrocarbon stream;

(f) separating the reduced pressure first liquefied hydrocarbon stream into a flash gas stream and a second liquefied hydrocarbon stream at a second liquefied hydrocarbon temperature that is less than the first liquefied hydrocarbon temperature;

(g) warming at least a portion of the flash gas stream by indirect heat exchange against at least one flash warming stream to form a recycle stream; and (h) combining at least a first portion of the recycle stream with the hydrocarbon feed stream before performing step (a).

2. The method of claim 1, wherein the second inlet pressure is at least 5 bara higher than the first inlet pressure.

3. The method of claim 1, wherein the first inlet stream composition has less than 75 mole % ethane and lighter hydrocarbons and the second inlet stream composition has more than 40 mole % ethane and lighter hydrocarbons.

4. The method of claim 1, wherein the second outlet pressure is at least 2 bara lower than the first outlet pressure.

5. The method of claim 1, further comprising:

(i) compressing and cooling the recycle stream after performing step (g) and before performing step (h).

6. The method of claim 1, wherein step (f) comprises:

(j) separating the reduced pressure first liquefied hydrocarbon stream into the flash gas stream and the second liquefied hydrocarbon stream at the second liquefied hydrocarbon temperature that is less than the first liquefied hydrocarbon temperature, the reduced pressure first liquefied hydrocarbon stream having a first flow rate and the flash gas stream having a second flow rate that is less than 30% of the first flow rate.

7. The method of claim 1, further comprising:

(k) adjusting at least one parameter selected from the group of (1) a precooled hydrocarbon temperature, (2) the first liquefied hydrocarbon temperature, and (3) the flash gas flow rate, to achieve a first desired ratio of a precooling power requirement to a liquefaction power requirement, the first desired ratio being between 0.2 and 0.7.

8. A method of cooling a hydrocarbon teed stream, and a second refrigerant teed stream by indirect heat exchange with a first refrigerant stream in each of a plurality of heat exchange sections of a precooling system and at least partially liquefying the hydrocarbon feed stream in a man heat exchanger, the precooling system comprising the plurality of heat exchange sections, at least one compression stage, and at least one aftercooler, wherein the hydrocarbon feed stream comprises a hydrocarbon fluid, the second refrigerant feed stream comprises a second mixed refrigerant, the at least one first refrigerant stream comprises the first mixed refrigerant, and the shell side first mixed refrigerant stream comprises the first mixed refrigerant, wherein the method comprises:

(a) introducing the hydrocarbon feed stream and the second refrigerant teed stream into a warmest heat exchange section of the plurality of heat exchange sections;

(b) cooling the hydrocarbon feed stream and the second refrigerant feed stream in each of the plurality of heat exchange sections to produce a precooled hydrocarbon stream and a precooled second refrigerant stream, the precooled second refrigerant stream being at least partially condensed;

(c) further cooling and at least partially liquefying the precooled hydrocarbon stream and the precooled second refrigerant stream in the main heat exchanger against the second refrigerant to produce a first liquefied hydrocarbon stream and a cooled second refrigerant stream;

(d) withdrawing a low pressure first refrigerant stream from a coldest heat exchange section of the plurality of heat exchange sections and compressing the low pressure first refrigerant stream in at least one compression stage;

(e) withdrawing a medium pressure first refrigerant stream from a first heat exchange section of the plurality of heat exchange sections, the first heat exchange section being warmer than the coldest heat exchange section; (f) combining the low pressure first refrigerant stream and the medium pressure first refrigerant stream to produce a combined first refrigerant stream after steps (d) and (e) have been performed;

(g) withdrawing from the compression system, a high-high pressure first refrigerant stream;

(h) cooling and at least partially condensing the high-high pressure first refrigerant stream in at least one cooling unit to produce a cooled high-high pressure first refrigerant stream;

(i) introducing the cooled high-high pressure first refrigerant stream into a first vapor-liquid separation device to produce a first vapor refrigerant stream and a first liquid refrigerant stream;

(j) introducing the first liquid refrigerant stream into the warmest heat exchange section of the plurality of heat exchange sections;

(k) cooling the first liquid refrigerant stream in the warmest heat exchange section of the plurality of heat exchange sections to produce a first cooled liquid refrigerant stream;

(l) expanding at least a portion of the first cooled liquid refrigerant stream to produce a first expanded refrigerant stream;

(m) introducing the first expanded refrigerant stream into the warmest heat exchange section to provide refrigeration duty to provide a first portion of the cooling of step (b);

(n) compressing at least a portion of the first vapor refrigerant stream of step (i) in at least one compression stage;

(o) cooling and condensing a compressed first refrigerant stream in at least one cooling unit to produce a condensed first refrigerant stream, the at least one cooling unit being downstream from and in fluid flow communication with the at least one compression stage of step (n);

(p) introducing the condensed first refrigerant stream into the warmest heat exchange section of the plurality of heat exchange sections;

(q) cooling the condensed first refrigerant stream in the first heat exchange section and the coldest heat exchange section to produce a first cooled condensed refrigerant stream;

(r) expanding the first cooled condensed refrigerant stream to produce a second expanded refrigerant stream;

(s) introducing the second expanded refrigerant stream into the coldest heat exchange section to provide refrigeration duty to provide a second portion of the cooling of step (b);

(t) expanding the first liquefied hydrocarbon stream to form a reduced pressure first liquefied hydrocarbon stream;

(u) separating the reduced pressure first liquefied hydrocarbon stream into a flash gas stream and a second liquefied hydrocarbon stream;

(v) warming at least a portion of the flash gas stream by indirect heat exchange against at least one flash warming stream to form a recycle stream; and (w) combining at least a first portion of the recycle stream with the hydrocarbon feed stream before performing step (a).

9. The method of claim 8, wherein the precooled second refrigerant stream is fully condensed after step (b).

10. The method of claim 8, further comprising:

(x) withdrawing a first intermediate refrigerant stream from the compression system prior to step (g); and (y) cooling the first intermediate refrigerant stream in at least one cooling unit to produce a cooled first intermediate refrigerant stream and introducing the cooled first intermediate refrigerant stream into the compression system prior to step (g).

11. The method of claim 8, further comprising:

(x) withdrawing a high pressure first refrigerant stream from the warmest heat exchange section of the plurality of heat exchange sections; and (y) introducing the high pressure first refrigerant stream into the compression system prior to step (g).

12. The method of claim 8, further comprising:

(x) withdrawing a high pressure first refrigerant stream from the warmest heat exchange section of the plurality of heat exchange sections; and (y) combining the high pressure first refrigerant stream with the cooled first intermediate refrigerant stream to form a combined first intermediate refrigerant stream, and introducing the combined first intermediate refrigerant stream into the compression system prior to step (g).

13. The method of claim 8, wherein step (n) further comprises:

(n) withdrawing a second intermediate refrigerant stream from the compression system and cooling the second intermediate refrigerant stream in at least one cooling unit to produce a cooled second intermediate refrigerant stream.

14. The method of claim 13, further comprising:

(x) introducing the cooled second intermediate refrigerant stream into a second vapor-liquid separation device to produce a second vapor refrigerant stream and a second liquid refrigerant stream;

(y) introducing the second liquid refrigerant stream into the warmest heat exchange section of the plurality of heat exchange sections; and (z) compressing the second vapor refrigerant stream in at least one compression stage of the compression system prior to producing the compressed first refrigerant stream of step (o).

15. The method of claim 8, further comprising:

(x) after step (v) and before step (w), compressing and cooling the recycle stream.

16. The method of claim 8, wherein step (v) further comprises:

(v) warming the flash gas stream by indirect heat exchange against at least one flash warming stream to form a recycle stream and at least one cooled flash warming stream, the at least one flash warming stream comprising at least one stream withdrawn from one selected from the group of the preceding system and a liquefaction system.

17. The method of claim 8, wherein step (v) further comprises:

(v) warming the flash gas stream by indirect heat exchange against at least one flash warming stream to form a recycle stream and at least one cooled flash warming stream, the at least one flash warming stream comprising a first portion of the precooled second refrigerant stream and the at least one cooled flash warming stream comprising a cooled first portion of the precooled second refrigerant stream.

18. The method of claim 8, further comprising:

(x) expanding the cooled second refrigerant stream to form an expanded second refrigerant stream;

(y) introducing the expanded second refrigerant stream into the main heat exchanger to provide refrigeration duty for step (c); and (z) combining the cooled first portion of the precooled second refrigerant stream with the cooled second refrigerant stream before performing step (x).

19. The method of claim 8, wherein step (g) further comprises:

(g) warming the flash gas stream by indirect heat exchange against at least one flash warming stream to form a recycle stream and at least one cooled flash warming stream, the at least one flash warming stream comprising a first portion of the condensed first refrigerant stream and the at least one cooled flash warming stream comprising a cooled first portion of the condensed refrigerant stream.

20. The method of claim 19, further comprising:

(x) combining the cooled first portion of the condensed refrigerant stream with the first cooled condensed refrigerant stream before performing step (r).

* * * * *